US009969159B2

(12) United States Patent
Naganuma et al.

(10) Patent No.: US 9,969,159 B2
(45) **Date of Patent: *May 15, 2018**

(54) LIQUID EJECTING HEAD AND LIQUID EJECTING APPARATUS

(71) Applicant: SEIKO EPSON CORPORATION, Tokyo (JP)

(72) Inventors: Yoichi Naganuma, Matsumoto (JP); Shunsuke Watanabe, Matsumoto (JP); Motoki Takabe, Suwa (JP); Shingo Tomimatsu, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/414,233

(22) Filed: Jan. 24, 2017

(65) Prior Publication Data

US 2017/0217172 A1 Aug. 3, 2017

(30) Foreign Application Priority Data

Jan. 29, 2016 (JP) ..... 2016-016285

(51) Int. Cl.
*B41J 2/14* (2006.01)
*B41J 2/045* (2006.01)

(52) U.S. Cl.
CPC ..... *B41J 2/14201* (2013.01); *B41J 2/0453* (2013.01); *B41J 2/14032* (2013.01); *B41J 2/14233* (2013.01); *B41J 2002/14241* (2013.01); *B41J 2002/14306* (2013.01);
(Continued)

(58) Field of Classification Search
CPC .. B41J 2/14145; B41J 2/14201; B41J 2/0453; B41J 2/14032; B41J 2002/14306; B41J 2/14233; B41J 2002/14491; B41J 2002/14241; B41J 2002/14419; B41J 2202/11
See application file for complete search history.

(56) References Cited

U.S. PATENT DOCUMENTS

2012/0013680 A1* 1/2012 Kitamura ..... B41J 2/16511 347/30
2015/0035910 A1 2/2015 Kinoshita et al.
2015/0352848 A1 12/2015 Watanabe et al.
(Continued)

FOREIGN PATENT DOCUMENTS

JP 2004-345226 12/2004
JP 2014-034138 2/2014
(Continued)

*Primary Examiner* — Yaovi M Ameh
(74) *Attorney, Agent, or Firm* — Workman Nydegger

(57) ABSTRACT

A liquid ejecting apparatus may include a flow path forming substrate in which a pressure generation chamber which communicates with a nozzle opening that discharges liquid is formed and a communication plate which has a supply path that communicates with a manifold. A recess portion which configures at least a part of the manifold is open on a side opposite to the flow path forming substrate, on the communication plate. The supply path includes a discharge supply path which communicates with a discharge pressure generation chamber that discharges liquid from the nozzle opening, and a dummy supply path which communicates with a dummy pressure generation chamber that does not discharge liquid from the nozzle opening.

15 Claims, 17 Drawing Sheets

(52) U.S. Cl.
CPC ..... *B41J 2002/14419* (2013.01); *B41J 2002/14491* (2013.01); *B41J 2202/11* (2013.01)

(56) References Cited

U.S. PATENT DOCUMENTS

| | | | | |
|---|---|---|---|---|
| 2017/0217173 | A1* | 8/2017 | Naganuma | B41J 2/14145 |
| 2017/0217179 | A1* | 8/2017 | Fukuda | B41J 2/14233 |

FOREIGN PATENT DOCUMENTS

| | | |
|---|---|---|
| JP | 2014-037133 | 2/2014 |
| JP | 2015-030153 | 2/2015 |

* cited by examiner

LIQUID EJECTING HEAD AND LIQUID EJECTING APPARATUS

BACKGROUND

1. Technical Field

The present invention relates to a liquid ejecting head which discharge liquid from a nozzle opening, and a liquid ejecting apparatus, particularly to an ink jet type recording head which discharges ink which is the liquid, and an ink jet type recording device.

2. Related Art

As an ink jet type recording head which is a representative example of a liquid ejecting head which ejects liquid droplets, for example, there is a liquid ejecting head which is provided with a nozzle opening and a pressure generation chamber that communicates with the nozzle opening, and which discharges ink droplets from the nozzle opening by generating a pressure change in ink on the inside of the pressure generation chamber by a pressure generation unit.

In the ink jet type recording head, a configuration in which a pressure chamber forming substrate on which a plurality of pressure generation chambers are generated, and a communication substrate on which a recess portion that configures at least a part of a common liquid chamber (also referred to as a manifold) which is common to and communicates with the plurality of pressure generation chamber, are layered, and the recess portion is provided on a side opposite to the pressure chamber forming substrate of the communication substrate, and a supply flow path which communicates with the recess portion and each pressure generation chamber is provided to penetrate along the layering direction on the communication substrate, is suggested (for example, refer to JP-A-2014-037133).

However, a sectional area (hole diameter) of the flow path or the flow path length of the supply path should be appropriately set since flow path resistance largely influences discharge characteristics of the ink, but when the flow path length is appropriately set, there is a problem that the depth of the recess portion which configures a part of the manifold decreases, and flow path resistance increase in the recess portion. Meanwhile, when the recess portion is formed to be deep, the flow path length of the supply path is not sufficient, and the supply path cannot be formed to have an appropriate flow path length.

In addition, it is also desirable to improve discharge characteristics of bubbles incorporated in the ink in the manifold.

In addition, the problems also similarly remain in the liquid ejecting head which ejects the liquid other than the ink not being limited to the ink jet type recording head.

SUMMARY

An advantage of some aspects of the invention is to provide a liquid ejecting head which can ensure a depth of a recess portion and a necessary length of a supply path, and can improve discharge characteristics of bubbles, a liquid ejecting apparatus.

According to an aspect of the invention, there is provided a liquid ejecting head including: a flow path forming substrate in which a pressure generation chamber which communicates with a nozzle opening that discharges liquid is formed; and a communication plate which has a supply path that communicates with a manifold which is common to and communicates with the plurality of pressure generation chambers, and the pressure generation chamber, in which the recess portion which configures at least a part of the manifold is provided to be open on a side opposite to the flow path forming substrate, on the communication plate, in which the recess portion is provided with a first recess portion, and a second recess portion which is deeper than the first recess portion, in which the supply path includes a discharge supply path which communicates with a discharge pressure generation chamber that discharges liquid from the nozzle opening, and a dummy supply path which communicates with a dummy pressure generation chamber that does not discharge liquid from the nozzle opening, in which the discharge supply path is provided to be open on a bottom surface of on the first recess portion, and in which the dummy supply paths are provided to be open on the bottom surface of the second recess portion.

In the aspect, by opening the discharge supply path on the bottom surface of the first recess portion, it is possible to ensure the length of the discharge supply path, and to improve discharge efficiency by reducing the pressure loss. In addition, by providing the second recess portion, it is possible to ensure a volume of the manifold, and to reduce the size thereof. Furthermore, by opening the dummy supply path on the bottom surface of the second recess portion, it is possible to reduce the flow path resistance of the dummy supply path to be lower than that of the discharge supply path, and to make it easy to discharge the bubbles incorporated in the liquid from the dummy supply path.

In the liquid ejecting head, it is preferable that the supply paths be arranged in the first direction, and at least one or more dummy supply paths be provided on an end portion side in the first direction. According to this, it is possible to discharge the bubbles of the end portion in the first direction in which the bubbles of the manifold are likely to remain, from the dummy supply path, and further, to improve the bubble discharge characteristics.

In the liquid ejecting head, it is preferable that the dummy supply paths be provided in each of both end portions in the first direction. According to this, it is possible to discharge the bubbles of both end portions in first direction in which the bubbles of the manifold are likely to remain, from the dummy supply path, and further, to improve the bubble discharge characteristics.

In the liquid ejecting head, it is preferable that the communication plate be a silicon substrate which becomes a plane in which a crystal plane orientation of a front surface is a {110} plane, the bottom surfaces of the first recess portion and the second recess portion be formed of a plane in which a crystal plane orientation is a {110} plane, between the first recess portion and the second recess portion, an inclined surface which is inclined toward the bottom surface of the second recess portion from the bottom surface of the first recess portion, be provided, and the inclined surfaces be formed of an arbitrary surface which is inclined with respect to the {110} plane, the {110} plane and a third {111} plane which is inclined with respect to a first {111} plane perpendicular to the {110} plane. According to this, it is possible to form the highly accurate first recess portion, the second recess portion, and the inclined surface by performing precise processing by the anisotropic etching. In addition, by providing the inclined surface, it is possible to prevent stagnation of a flow of the liquid, and to further improve bubble discharge characteristics.

In the liquid ejecting head, it is preferable that, on the inclined surfaces, a plurality of second inclined surface formed on the third {111} planes be arranged throughout the first direction which is the arranging direction of the supply path, and a pitch of the second inclined surfaces adjacent to each other in the first direction be greater than a pitch of the supply paths adjacent to each other in the first direction. According to this, the bubbles are likely to move in the first direction along the inclined surface, and the bubbles are likely to be discharged from the dummy supply path.

In the liquid ejecting head, it is preferable that the pitch of the second inclined surface be equal to or less than 42.4 μm. According to this, it is possible to prevent the bubbles which move along the inclined surface from being caught.

In the liquid ejecting head, it is preferable that a pitch of the dummy supply paths adjacent to each other be greater than a pitch of the discharge supply paths adjacent to each other. According to this, it is possible to widen a cross-sectional area of the dummy supply path and the flow path which communicates therewith, and to further reduce the flow path resistance of the flow path from the dummy supply path until discharging the liquid compared to the flow path until the discharge of the discharge supply path.

According to another aspect of the invention, there is provided a liquid ejecting apparatus including: the liquid ejecting head according to the above-described aspect.

In the aspect, it is possible to improve discharge efficiency by reducing the pressure loss, and to realize a liquid ejecting apparatus in which the bubble discharge characteristics are improved.

In addition, it is preferable that a suction unit which performs a suction operation only from the nozzle opening which communicates with the dummy pressure generation chamber be provided. According to this, it is possible to efficiently discharge the bubbles in the manifold via the dummy pressure generation chamber by efficiently performing the suction operation.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail based on the embodiments.

Embodiment 1

Figure 1:
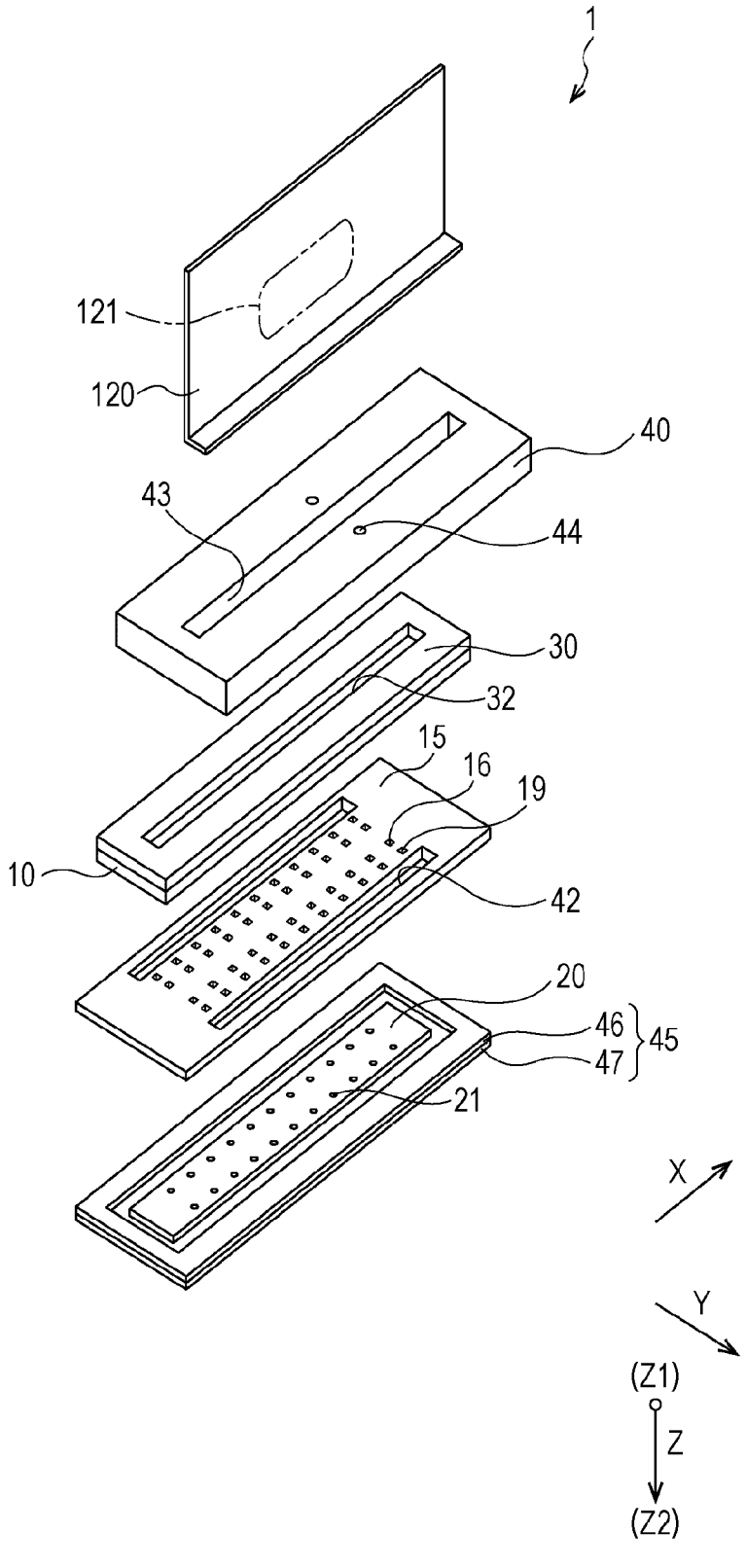
FIG. 1 is an exploded perspective view of a recording head according to Embodiment 1 of the invention.
Figure 2:
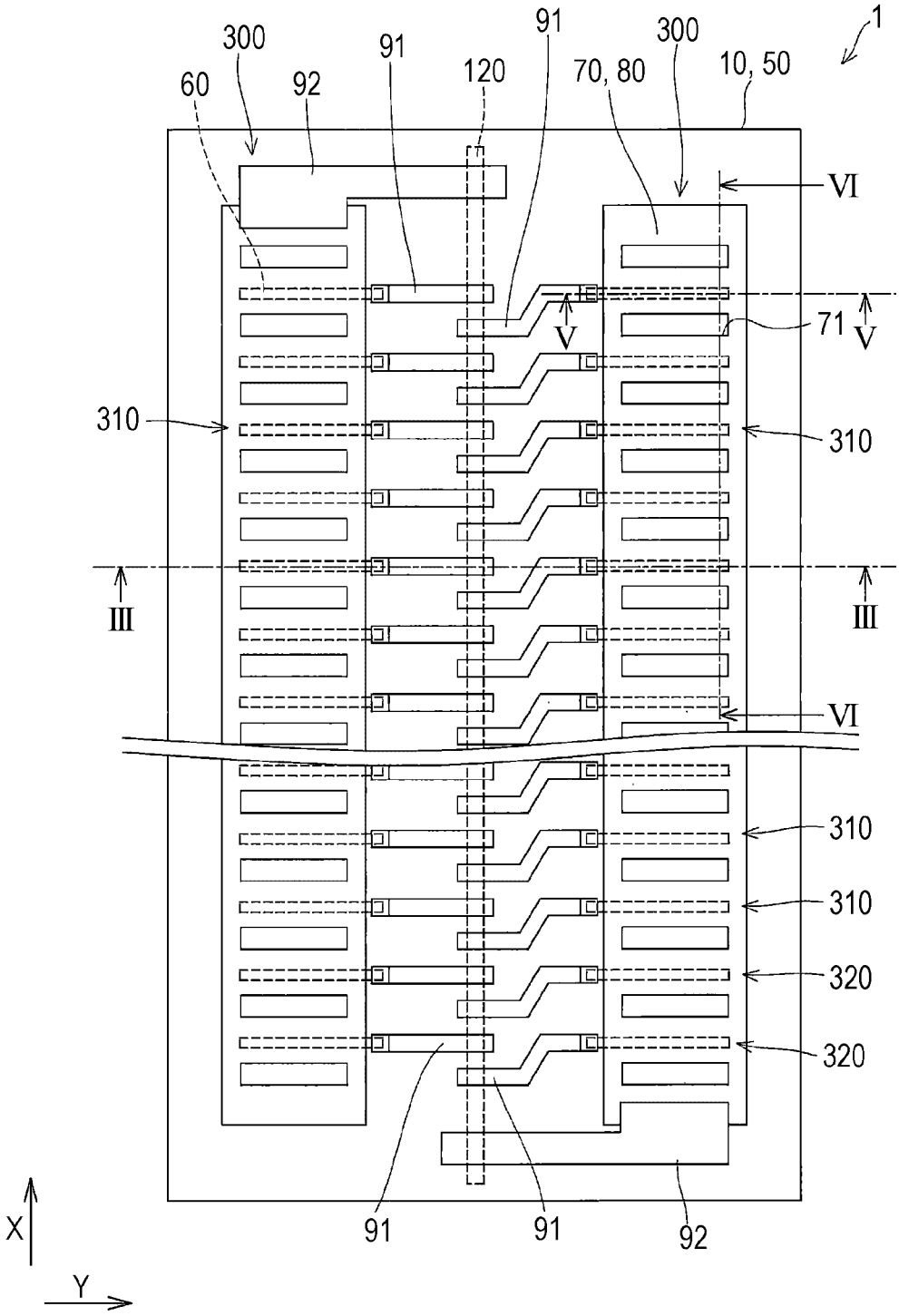
FIG. 2 is a plan view of a flow path forming substrate according to Embodiment 1 of the invention.
Figure 3:
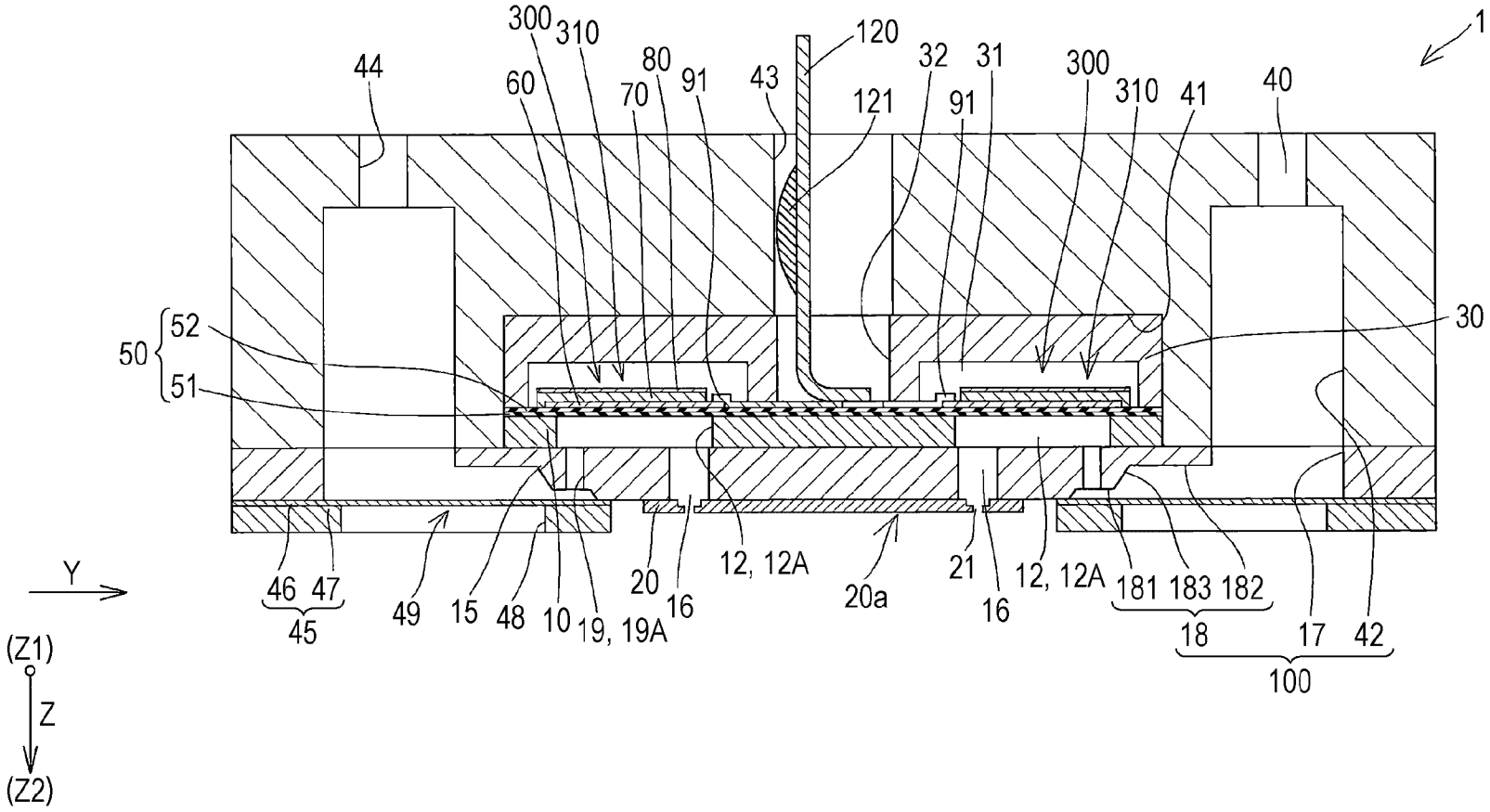
FIG. 3 is a sectional view of the recording head according to Embodiment 1 of the invention.
Figure 4:
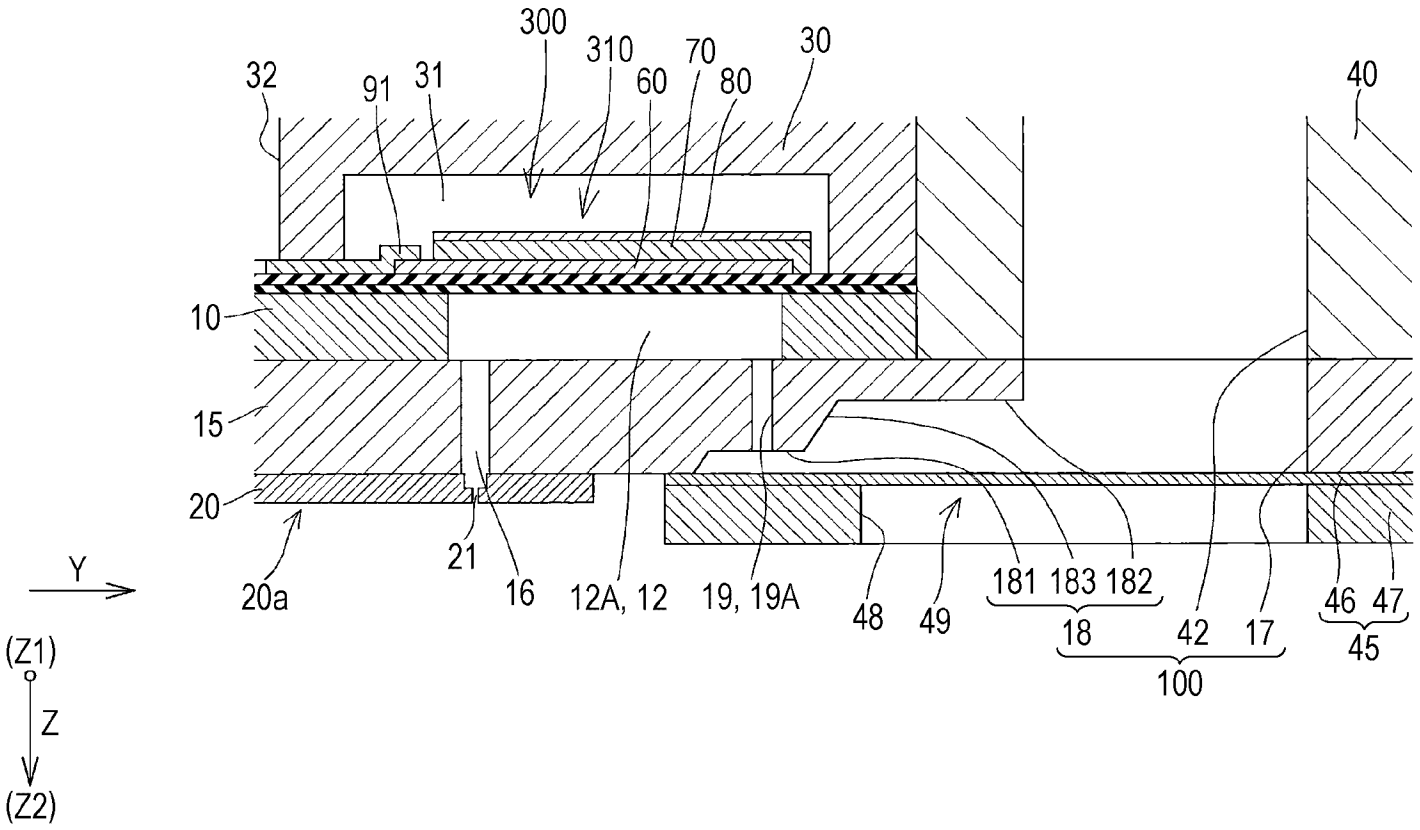
FIG. 4 is a sectional view in which main portions of the recording head according to Embodiment 1 of the invention are enlarged.
Figure 5:
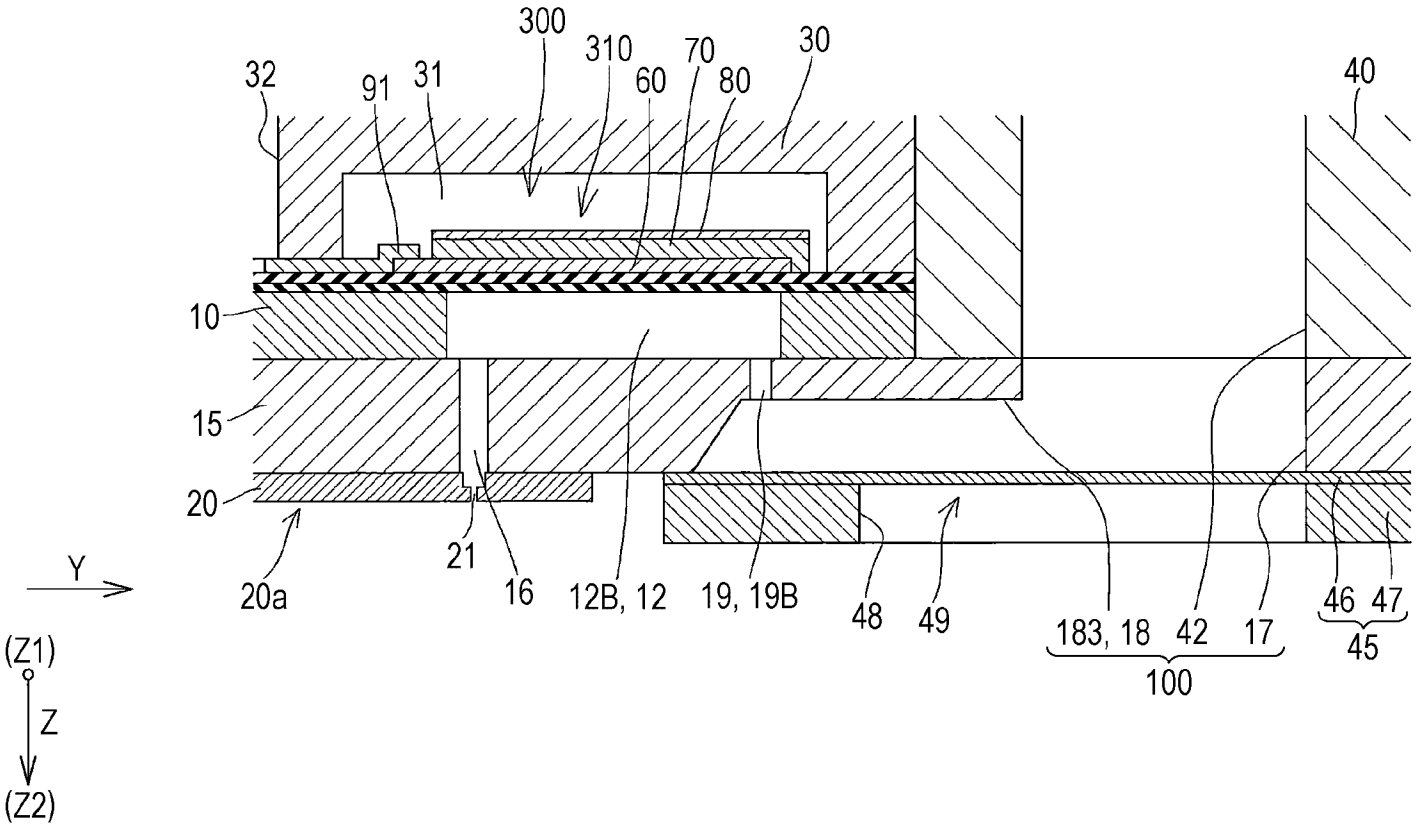
FIG. 5 is a sectional view in which the main portions of the recording head according to Embodiment 1 of the invention are enlarged.
Figure 6:
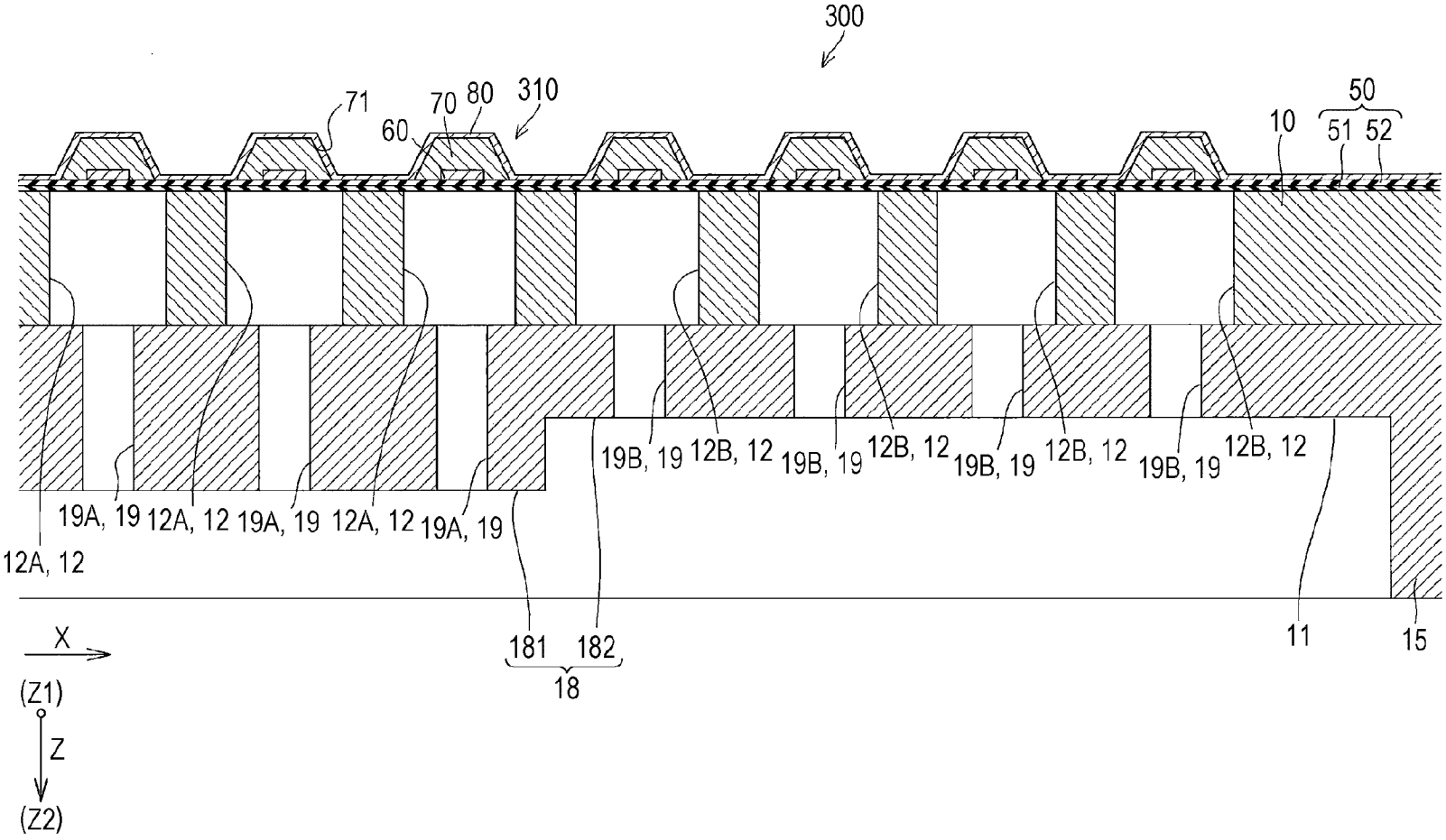
FIG. 6 is a sectional view in which the main portions of the recording head according to Embodiment 1 of the invention are enlarged.
Figure 7:
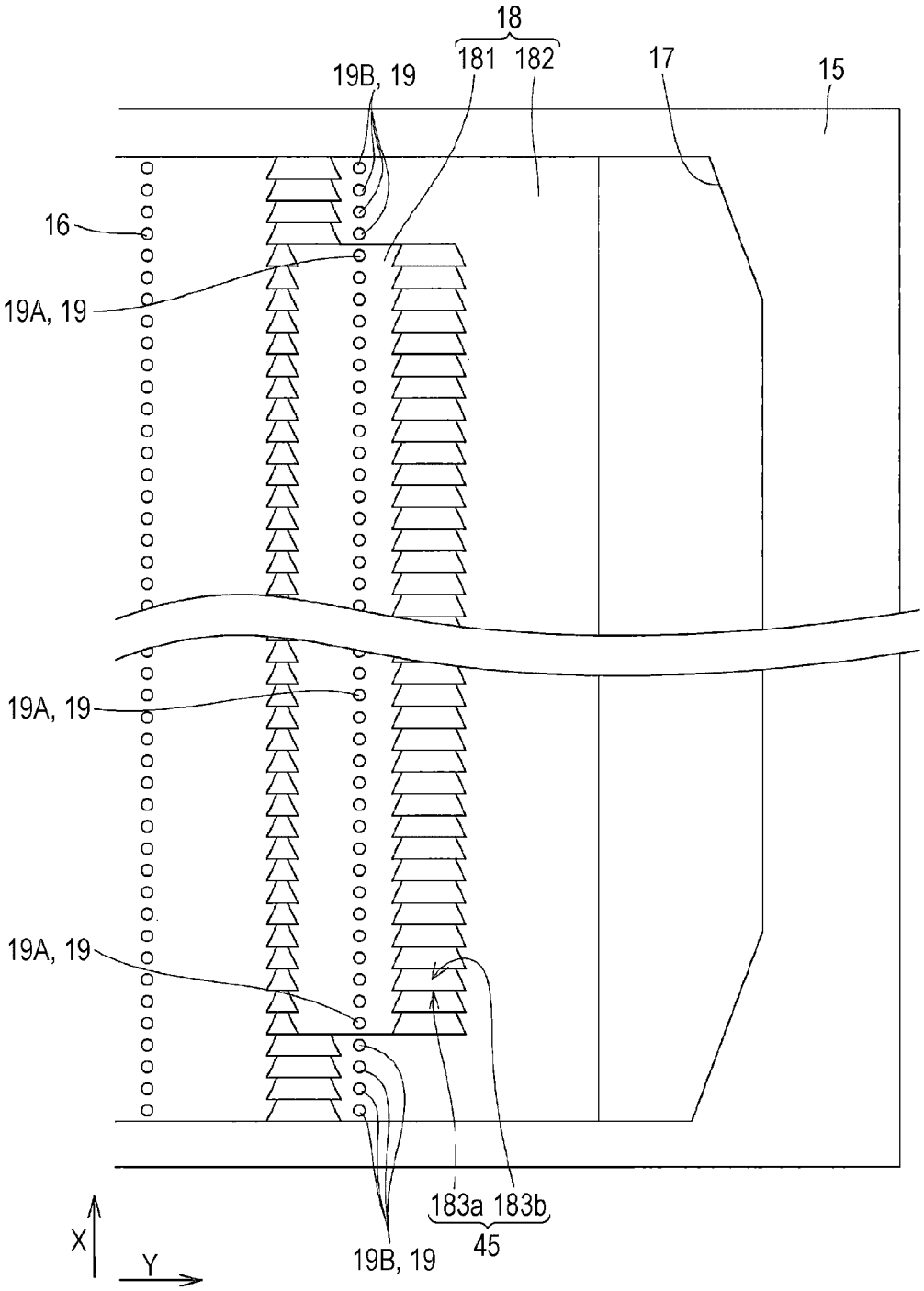
FIG. 7 is a plan view of a communication plate according to Embodiment 1 of the invention.
Figure 8:
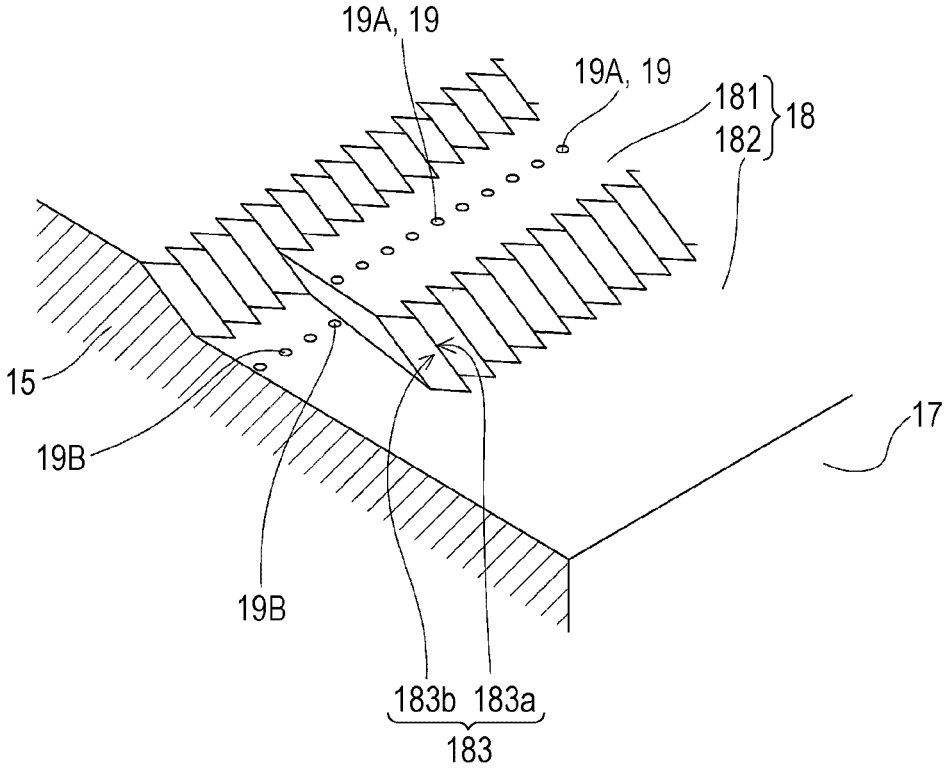
FIG. 8 is a perspective view in which main portions of the communication plate according to Embodiment 1 of the invention are cut out.

FIG. 1 is an exploded perspective view of an ink jet type recording head which is a liquid ejecting head according to Embodiment 1 of the invention, FIG. 2 is a plan view of main portions of a flow path forming substrate of a recording head, FIG. 3 is a sectional view taken along the line III-III in FIG. 2, FIG. 4 is a view in which main portions of FIG. 3 are enlarged, FIG. 5 is a sectional view taken along the line V-V in FIG. 2, FIG. 6 is a sectional view taken along the line VI-VI of FIG. 2, FIG. 7 is a plan view of a communication plate, and FIG. 8 is a perspective view in which main portions of the communication plate are cut out.

As illustrated in the drawings, in a flow path forming substrate 10 which configures an ink jet type recording head 1 (hereinafter, also simply referred to as a recording head 1) of the embodiment, by performing anisotropic etching from one surface side, pressure generation chambers 12 which are divided by a plurality of partition walls 11, are arranged along the direction in which a plurality of nozzle openings 21 which discharge ink are arranged. Hereinafter, the direction is referred to as the arranging direction of the pressure generation chamber 12, or a first direction X. In addition, in the flow path forming substrate 10, the number of rows in which the pressure generation chambers 12 are arranged in the first direction X is plural, and in the embodiment, the number of rows is two. An arranging direction in which the plurality of rows of pressure generation chambers 12 are arrayed is referred to as a second direction Y hereinafter. Furthermore, a direction orthogonal to both of the first direction X and the second direction Y is referred to as a third direction Z. Specifically, a case member 40 side which will be described later is referred to as a Z1 side, and a nozzle plate 20 side is referred to as a Z2 side. In addition, the first direction X, the second direction Y, and the third direction Z are directions which are orthogonal to each other, but not being particularly limited thereto, the directions may be directions which intersect each other by an angle other than an orthogonal angle.

On a surface side on the Z2 side of the flow path forming substrate 10, a communication plate 15 and the nozzle plate 20 are layered in order.

In the communication plate 15, as illustrated in FIGS. 3 and 4, the nozzle communication path 16 which communicates with the pressure generation chamber 12 and the nozzle opening 21 is provided. The communication plate 15 has an area greater than the flow path forming substrate 10, and the nozzle plate 20 has an area smaller than the flow path forming substrate 10. In this manner, in order to separate the nozzle opening 21 of the nozzle plate 20 and the pressure generation chamber 12 from each other by providing the communication plate 15, the ink which is in the pressure generation chamber 12 is unlikely to receive influence of evaporation of moisture in the ink generated in the ink in the vicinity of the nozzle opening 21. In addition, since the nozzle plate 20 may only cover the opening of the nozzle communication path 16 which communicates with the pressure generation chamber 12 and the nozzle opening 21, it is possible to relatively reduce the area of the nozzle plate 20, and to achieve reduction of costs. In addition, in the embodiment, the nozzle opening 21 of the nozzle plate 20 is open, and a surface on which ink droplets are discharged is referred to as a liquid ejecting surface 20*a*.

In addition, in the communication plate 15, a first manifold portion 17 which configures a part of a manifold 100, and a second manifold portion 18 which is a recess portion of the embodiment, are provided.

The first manifold portion 17 is provided to penetrate the communication plate 15 in the third direction Z.

In addition, the second manifold portion 18 becomes a recess portion provided to be open on the nozzle plate 20 side of the communication plate 15 without penetrating the communication plate 15 in the third direction Z.

Here, as illustrated in FIGS. 4 to 8, the second manifold portion 18 includes a first recess portion 181 which is open to a surface on the Z2 side opposite to the flow path forming substrate 10, and a second recess portion 182 which is open to the surface on the Z2 side, and is deeper than the first recess portion 181. The first recess portion 181 and the second recess portion 182 are formed to be arranged in the second direction Y, and the first recess portion 181 is disposed on a side opposite to the first manifold portion 17 of the second recess portion 182.

The first recess portion 181 and the second recess portion 182 are formed in a shape of steps due to a difference in depth in the third direction Z. In other words, when viewed from the second recess portion 182, the first recess portion 181 is formed at a part in a shape of a platform which is elevated to the Z2 side. In addition, between the first recess portion 181 and the second recess portion 182, an inclined surface 183 which is inclined toward a bottom surface of the first recess portion 181 from a bottom surface of the second recess portion 182, is provided. The inclined surface 183 is provided to be inclined with respect to the third direction Z, and the inclination direction of the inclined surface 183 is the direction toward the bottom surface of the first recess portion 181 from the bottom surface of the second recess portion 182, that is, the direction in which the width of the second recess portion 182 in the second direction Y gradually increases. In addition, the bottom surface of the first recess portion 181 and the bottom surface of the second recess portion 182 are surfaces on each Z1 side of the first recess portion 181 and the second recess portion 182. In the embodiment, the bottom surface of the first recess portion 181 and the bottom surface of the second recess portion 182 are flat surfaces including the first direction X and the second direction Y, and but not being particularly limited thereto, for example, the bottom surface of the first recess portion 181 and the bottom surface of the second recess portion 182 may be surfaces which are inclined with respect to the direction orthogonal to the third direction Z.

Here, in the embodiment, the communication plate 15 is made of a silicon substrate (silicon single crystal substrate) of a plane in which a crystal plane orientation of a front surface is a {110} plane. In addition, at least the second manifold portion 18 is formed by performing anisotropic etching (wet etching) in which an alkaline solution, such as KOH, is used from a surface on the Z1 side, with respect to the communication plate 15. The anisotropic etching is performed by using a difference in etching rate of the silicon single crystal substrate. In the embodiment, since the silicon single crystal substrate in which the surface orientation of the surfaces on the Z1 side and the Z2 side of the communication plate 15 is a {110} plane is used, compared to an etching rate on the {110} plane of the silicon single crystal substrate, the anisotropic etching is performed by using properties that the etching rate of a {111} plane is approximately 1/180. In other words, when the silicon single crystal substrate is immersed in the alkaline solution, a first {111} plane which is perpendicular to the {110} plane that gradually erodes, a second {111} plane which makes an angle of approximately 70 degrees with the first {111} plane, and is perpendicular to the above-described {110} plane, and a third {111} plane which makes an angle of approximately 35 degrees with the above-described {110} plane, and makes an angle of 54.74 degrees with the first {111} plane, appear. In the embodiment, the bottom surface of the first recess portion 181 and the bottom surface of the second recess portion 182 are formed on the {110} plane. In addition, the inclined surface 183 is formed as a first inclined surface 183*a* which is formed on an arbitrary surface (having a high etching rate), and a second inclined surface 183*b* which is formed on the third {111} plane, are alternately arranged in the first direction X. In other words, the inclined surface 183 is formed as the first inclined surface 183*a* and the second inclined surface 183*b* which have different angles from each other are alternately arranged in the first direction X.

In addition, in the communication plate 15, a supply path 19 which communicates with one end portion in the second direction Y of the pressure generation chamber 12 is independently provided in accordance with each of the pressure generation chambers 12. The supply path 19 communicates with the second manifold portion 18 and the pressure generation chamber 12. In other words, the supply path 19 are formed to be alternately arranged in the first direction X.

Here, as illustrated in FIG. 6, the pressure generation chamber 12 of the embodiment is divided into a discharge pressure generation chamber 12A which is used in discharging the ink droplets from a communicating nozzle opening 21, a dummy pressure generation chamber 12B not which is used in discharging the ink droplets from the communicating the nozzle opening 21. In addition, the dummy pressure generation chamber 12B which is not used in discharging the ink droplets is called a member which is not used in printing, that is, forming characters or images by landing the ink droplets to an ejecting medium, such as a paper sheet or a recording sheet. In other words, the ink droplets which are discharged from the nozzle opening 21 which communicates with the discharge pressure generation chamber 12A are used in printing. Meanwhile, when the ink droplets are not used in printing, that is, when the ink droplets are not landed to the ejecting medium, the ink droplets may be discharged by driving the piezoelectric actuator 300 from the nozzle opening 21 which communicates with the dummy pressure generation chamber 12B. In addition, the ink is discharged during the cleaning from the nozzle opening 21 which communicates with the dummy pressure generation chamber 12B. Meanwhile, as the cleaning, suction cleaning of suctioning the ink on the inside of the dummy pressure generation chamber 12B and the manifold 100 from the nozzle opening 21 together with foreign materials, such as the bubbles or dust, by discharging the ink droplets, which is a so-called brushing, by covering the nozzle opening 21 with the cap, and by making the pressure into a negative pressure on the inside of the cap by the suction pump or the like, is performed.

In the embodiment, among the pressure generation chambers 12 which are aligned in the first direction X, one or more pressure generation chambers 12 which are provided on both end portions in the first direction X are the dummy pressure generation chambers 12B, and other pressure generation chambers 12 are the discharge pressure generation chambers 12A. In addition, in the embodiment, four dummy pressure generation chambers 12B are provided in each of both end portions in the first direction X, and a total of eight dummy pressure generation chambers 12B are provided.

The supply paths 19A which communicate with the pressure generation chamber 12 and the manifold 100 are arranged in a linear shape in the first direction X as described above. In addition, as illustrated in FIGS. 4 to 8, a discharge supply path 19A which communicates with the discharge pressure generation chamber 12A and the manifold 100 is provided to be open on the bottom surface of the first recess portion 181. Meanwhile, among the supply paths 19, the discharge supply path 19A is provided to open on the bottom surface of the second recess portion 182. In other words, among the supply paths 19, at a part at which a dummy supply path 19B is open, the second recess portion 182 is formed. In other words, since the supply paths 19 are arranged in the first direction X, the first recess portion 181 is provided on a center portion side in the arranging direction of the supply paths 19, and the second recess portion 182 extends to both end portion sides in the arranging direction of the supply path 19. In this manner, as the discharge supply path 19A is open on the bottom surface of the first recess portion 181, as illustrated in FIGS. 4 and 6, it is possible to ensure the flow path length of the discharge supply path 19A that communicates with the manifold 100 and the discharge pressure generation chamber 12A to be long. Meanwhile, by opening the dummy supply path 19B on the bottom surface of the second recess portion 182, as illustrated in FIGS. 5 and 6, it is possible to shorten the length of the dummy supply path 19B that communicates with the manifold 100 and the dummy pressure generation chamber 12B compared to the discharge supply path 19A. In addition, in the embodiment, the discharge supply path 19A and the dummy supply path 19B, in the embodiment, as being open on a surface the same as that on the Z1 side in the third direction Z, a difference in length is generated. Therefore, in a case where the discharge supply path 19A and the dummy supply path 19B are positioned at different positions of being open on the Z1 side, it is necessary to dispose an opening on the Z1 side so that a relationship of the length between the discharge supply path 19A and the dummy supply path 19B is the same as the above-described condition.

In this manner, by opening the discharge supply path 19A on the bottom surface of the first recess portion 181, as illustrated in FIGS. 4 and 5, it is possible to ensure the flow path length of the discharge supply path 19A which communicates with the manifold 100 and the discharge pressure generation chamber 12A. In this manner, by opening the discharge supply path 19A on the bottom surface of the first recess portion 181, without being influenced by the length of the discharge supply path 19A and the depth of the second recess portion 182, it is possible to appropriately set the necessary length. In other words, it is possible to ensure the length of the discharge supply path 19A, to reduce the pressure loss of the discharge supply path 19A, and to improve the discharge efficiency. Meanwhile, the pressure loss in the discharge supply path 19A is determined by the length of the opening diameter of the discharge supply path 19A, but there is a technical restriction in reducing the size of the opening. Therefore, in a case where the discharge efficiency is not sufficient, it is necessary to ensure the length, and to improve the discharge efficiency by the diameter of the opening of the supply path 19A. In the embodiment, by opening the supply path 19A on the bottom surface of the first recess portion 181 which is more shallow than the second recess portion 182, even when it is difficult to reduce the size of the diameter of the opening of the supply path 19A, it is possible to ensure the length, and to improve the discharge efficiency. In addition, by providing the second recess portion 182 which is deeper than the first recess portion 181 on which the supply path 19A is open, it is possible to ensure a volume of the second manifold portion 18, to reduce the pressure loss in the second manifold portion 18, and to improve the discharge efficiency. In addition, by employing such a configuration, even when there is a tendency for the thickness in the third direction Z of the communication plate 15 to become thin, since it is possible to ensure both the length of the supply path 19A and the depth (the depth of the second recess portion 182) of the second manifold portion 18, without deterioration of the ink discharge characteristics or the like, that is, without influence on the discharge characteristics, it is possible to achieve a small size of the recording head 1.

Figure 9:
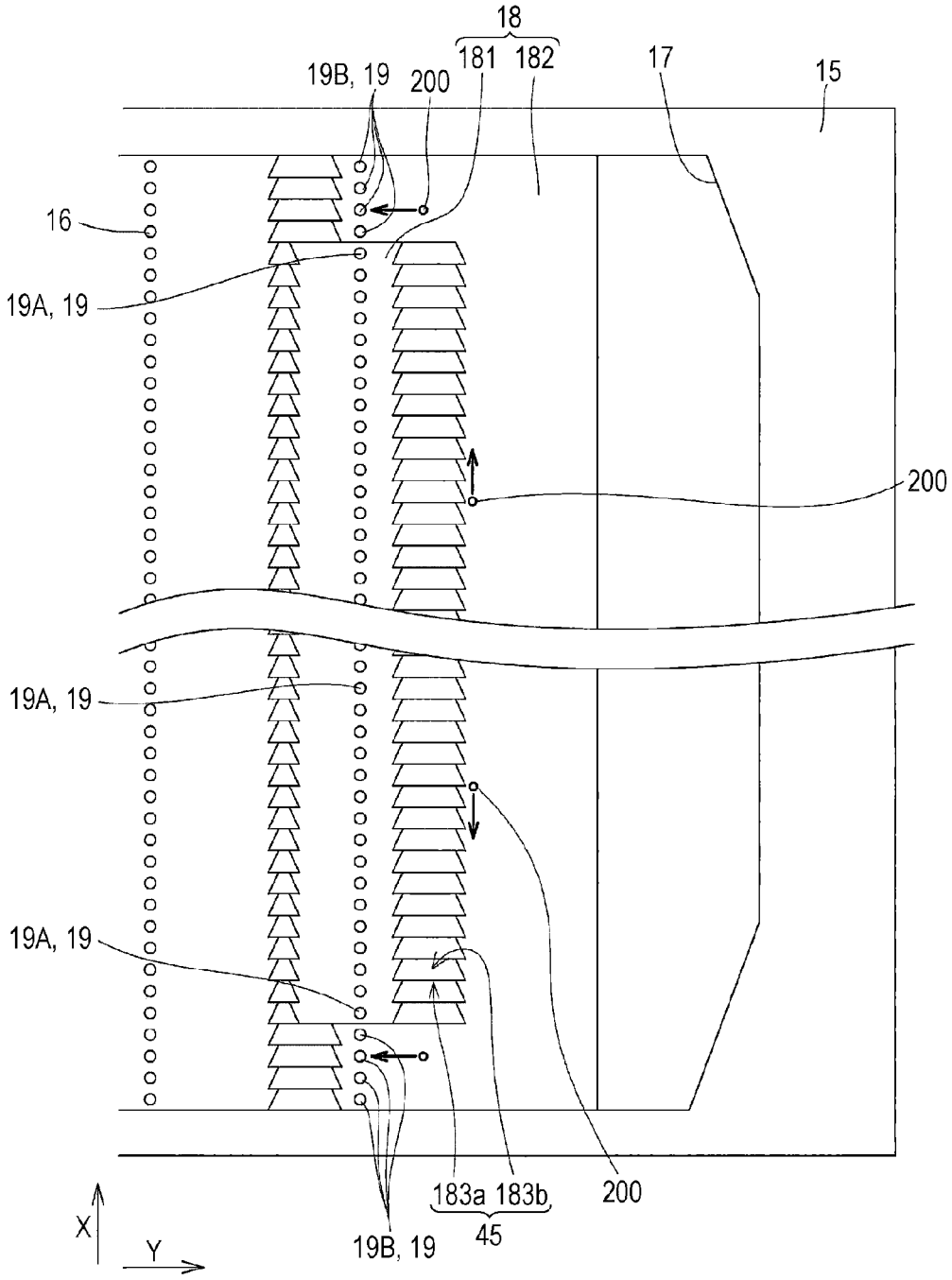
FIG. 9 is a plan view of the communication plate illustrating a flow of bubbles according to the Embodiment 1 of the invention.

In addition, by opening the dummy supply path 19B on the bottom surface of the second recess portion 182, and by shortening the length, it is possible to reduce the flow path resistance of the dummy supply path 19B than the flow path resistance of the discharge supply path 19A. Therefore, when the suction-cleaning is performed by the suction operation from all of nozzle openings 21, in the flow path which passes through the supply path 19 from the manifold 100 to the nozzle opening 21, a flow amount of the flow path which passes through the dummy supply path 19B increases. Therefore, the bubbles incorporated in the ink on the inside of the manifold 100 are discharged via the dummy supply path 19B having a low flow path resistance. In addition, since the dummy supply path 19B is open on the bottom surface of the second recess portion 182, the ink supplied to the second manifold portion 18 from the first manifold portion 17 and the bubbles incorporated therein, are likely to reach the opening of the dummy supply path 19B without exceeding the inclined surface 183. In particular, when the pressure generation chamber 12 is disposed to be on the upper side in the vertical direction with respect to the second manifold portion 18, since the bubbles incorporated in the ink move to the upper side in the vertical direction by a buoyant force, it becomes difficult that the bubbles move to the lower side in the vertical direction and exceed the inclined surface 183, and the bubbles are unlikely to reach the opening of the discharge supply path 19A. Therefore, as illustrated in FIG. 9, the bubbles 200 incorporated in the ink on the inside of the manifold 100 move in the first direction X along the inclined surface 183 on the bottom surface (the ceiling surface in the vertical direction) of the second recess portion 182, and are likely to reach the dummy supply path 19B which is open on the bottom surface of the second recess portion 182. Therefore, the bubbles 200 incorporated in the ink on the inside of the manifold 100 are easily discharged from the nozzle opening 21 via the dummy supply path 19B and the dummy pressure generation chamber 12B, and it is possible to improve the bubble discharge characteristics. In addition, since it is possible to prevent the bubbles 200 incorporated in the ink from being incorporated into the discharge pressure generation chamber 12A from the discharge supply path 19A, it is possible to prevent a discharge failure of the ink droplets as the bubbles 200 incorporated in the discharge pressure generation chamber 12A remain without being discharged. In addition, a case where the suction-cleaning is performed with respect to all of the nozzle openings 21 is described, but it is needless to say that the suction-cleaning may be performed only with respect to the nozzle opening 21 which communicates with the dummy pressure generation chamber 12B.

In other words, suctioning means for performing the suction operation only from the nozzle opening 21 which communicates with the dummy pressure generation chamber 12B, may be provided. As the suctioning means, it is possible to use means known in the related art which includes the cap that abuts against the liquid ejecting surface 20*a* and covers the nozzle opening 21, and a suctioning apparatus, such as a suctioning pump, which suctions the inside of the cap and makes the pressure into a negative pressure. Meanwhile, in a case where the suctioning means suctions only the nozzle opening 21 which communicates with the dummy pressure generation chamber 12B, the cap which covers only the nozzle opening 21 that communicates with the dummy pressure generation chamber 12B may be used. In addition, in a case where the cap covers the entire nozzle opening 21, shutting means which shuts a part other than the nozzle opening 21 that communicates with the dummy pressure generation chamber 12B, may further be provided. In this manner, even in a case where the suction-cleaning is performed only from the nozzle opening 21 that communicates with the dummy pressure generation chamber 12B, it is possible to efficiently discharge the bubbles of the ink from the dummy supply path 19B having a low flow path resistance. In addition, in the embodiment, the dummy supply paths 19B are provided in each of both end portions in the first direction X which is the arranging direction of the supply path 19. Therefore, it is possible to discharge the bubbles of both end portions in the first direction X in which the bubbles are likely to remain on the inside of the manifold 100 from the dummy supply path 19B, and to further prevent the bubbles from remaining.

Furthermore, since the inclined surface 183 is provided between the first recess portion 181 and the second recess portion 182, it is possible to make the angle made by the bottom surfaces of the inclined surface 183 and the second recess portion 182 into an obtuse angle. Therefore, it is possible to improve the flow of the ink of the angle portion between the bottom surfaces of the inclined surface 183 and the second recess portion 182, and to prevent the bubbles from remaining in the angle portion. In addition, in the embodiment, since the first recess portion 181 is also formed by the anisotropic etching, an inclined surface similar to the inclined surface 183 is also formed between the first recess portion 181 and a surface to which the nozzle plate 20 of the communication plate 15 is bonded.

In the nozzle plate 20 which is bonded to the Z2 side of the communication plate 15, the nozzle openings 21 which communicate with each pressure generation chamber 12 via the nozzle communication path 16 are formed. In other words, nozzle openings 21 which eject the same type of liquid (ink) are aligned in the first direction X, and rows of the nozzle openings 21 which are aligned in the first direction X are formed in two rows in the second direction Y.

Meanwhile, on a surface side on the Z1 side of the flow path forming substrate 10, a vibrating plate 50 is formed. In the embodiment, as the vibrating plate 50, an elastic film 51 made of silicon oxide provided on the flow path forming substrate 10 side, and an insulating body film 52 made of zirconium oxide provided on the elastic film 51, are provided. In addition, the liquid flow path, such as the pressure generation chamber 12, is formed by performing the anisotropic etching the flow path forming substrate 10 from one surface side (surface side to which the nozzle plate 20 is bonded) and the other surface of the pressure generation chamber 12 is divided by the elastic film 51.

In addition, on the vibrating plate 50 of the flow path forming substrate 10, a piezoelectric actuator 300 is configured by layering a first electrode 60, a piezoelectric body layer 70, and a second electrode 80 by forming a film and by performing a lithography method. In the embodiment, the piezoelectric actuator 300 becomes a pressure generator which generates a pressure change of the ink on the inside of the pressure generation chamber 12. Here, the piezoelectric actuator 300 may also be a piezoelectric element 300, and is a part including the first electrode 60, the piezoelectric body layer 70, and the second electrode 80. In addition, when the voltage is applied between the first electrode 60 and the second electrode 80, a part at which piezoelectric distortion is generated in the piezoelectric body layer 70 is referred to as an active portion 310. In the embodiment, will be described later, but the active portions 310 are formed in each of the pressure generation chambers 12. In other words, the plurality of active portions 310 are formed on the flow path forming substrate 10. In addition, in general, any one electrode of the active portion 310 is a common electrode which is common to the plurality of active portions 310, and the other electrode is configured as individual electrodes which are independent in each active portion 310. In the embodiment, the first electrode 60 is an individual electrode, and the second electrode 80 is a common electrode, but may be reverse to each other. In addition, in the above-described example, the vibrating plate 50 and the first electrode 60 act as the vibrating plate, but not being limited thereto, for example, without providing the vibrating plate 50, only the first electrode 60 may act as the vibrating plate. In addition, the piezoelectric actuator 300 itself may substantially serve as the vibrating plate.

Here, the first electrode 60 which configures the piezoelectric actuator 300 of the embodiment is isolated by each of the pressure generation chambers 12, and configures the individual electrode which are independent in each of the active portions 310 that is an actual driving portion of the piezoelectric actuator 300. The first electrode 60 is formed to have a width narrower than the width of the pressure generation chamber 12 in the first direction X of the pressure generation chamber 12. In other words, in the first direction X of the pressure generation chamber 12, an end portion of the first electrode 60 is disposed on the inner side of a region opposes the pressure generation chamber 12. In addition, in the second direction Y, both end portions of the first electrode 60 respectively extend to the outer side of the pressure generation chamber 12.

The piezoelectric body layers 70 are provided to be continuous throughout the first direction X to have a predetermined width in the second direction Y. The width in the second direction Y of the piezoelectric body layer 70 is wider than the length in the second direction Y of the pressure generation chamber 12. Therefore, in the second direction Y of the pressure generation chamber 12, the piezoelectric body layer 70 is provided to the outer side of the pressure generation chamber 12.

In the second direction Y of the pressure generation chamber 12, the end portion on the supply path 19 side of the piezoelectric body layer 70 is disposed further outwards than the end portion of the first electrode 60. In other words, the end portion of the first electrode 60 is covered with the piezoelectric body layer 70. In addition, the end portion on the nozzle opening 21 side of the piezoelectric body layer 70 is disposed further inwards (the pressure generation chamber 12 side) than the end portion of the first electrode 60, and the end portion on the nozzle opening 21 side of the first electrode 60 is not covered with the piezoelectric body layer 70.

The piezoelectric body layer 70 is made of a piezoelectric material of an oxide having a polarization structure formed on the first electrode 60, and for example, the piezoelectric body layer 70 can be made of a perovskite type oxide illustrated by a general equation $ABO_3$, and can be made of a lead based piezoelectric material including lead or a non-lead based piezoelectric material which does not include lead.

In the piezoelectric body layer 70, a recess portion 71 which corresponds each partition wall is formed. The width in the first direction X of the recess portion 71 is substantially the same as the width in the first direction X of each partition wall, or is wider than that. Accordingly, since rigidity of a part (a so-called arm portion of the vibrating plate 50) which opposes the end portion in the second direction Y of the pressure generation chamber 12 of the vibrating plate 50 is prevented, it is possible to excellently displace the piezoelectric actuator 300.

The second electrode 80 is provided on a surface opposite to the first electrode 60 of the piezoelectric body layer 70, and configures a common electrode which is common to a plurality of active portions 310. In addition, the second electrode 80 may be provided on an inner surface of the recess portion 71, that is, a side surface of the recess portion 71 of the piezoelectric body layer 70, or may not be provided.

In addition, an individual wiring 91 which is a lead-out wiring is led out from the first electrode 60 of the piezoelectric actuator 300. In addition, a common wiring 92 which is a lead-out wiring is led out from the second electrode 80. Furthermore, a flexible cable 120 is connected to the end portions which are arranged on a side opposite to the end portion connected to the piezoelectric actuator 300 of the individual wiring 91 and the common wiring 92. The flexible cable 120 is a wiring substrate having flexibility, and in the embodiment, a driving circuit 121 which is a driving element is mounted thereon.

A protection substrate 30 which has a size substantially the same as the flow path forming substrate 10 is bonded to the surface side on the Z1 side of the flow path forming substrate 10. The protection substrate 30 has a holding portion 31 which is a space for protecting the piezoelectric actuator 300. Two holding portions 31 are formed to be aligned in the second direction Y between the rows of the piezoelectric actuator 300 that are arranged in the first direction X. In addition, in the protection substrate 30, a through hole 32 which penetrates in the third direction Z between the two holding portions 31 that are arranged in the second direction Y, is provided. The end portions of the individual wiring 91 and the common wiring 92 which are led out from the electrode of the piezoelectric actuator 300 extends to be exposed to the inside of the through hole 32, and the individual wiring 91 and the common wiring 92, and the flexible cable 120 are electrically connected to each other on the inside of the through hole 32. In addition, a connecting method of the individual wiring 91 and the common wiring 92, and the flexible cable 120, is not particularly limited, and for example, conductive adhesive (ACP, ACF) including conductive particles, a non-conductive adhesive (NCP, NCF), or the like, including brazing and soldering, such as soldering or brazing, eutectic bonding, or welding, is employed.

In addition, the case member 40 which divides the manifold 100 that communicates with the plurality of pressure generation chambers 12 together with the flow path forming substrate 10, is fixed onto the protection substrate 30. The case member 40 has a shape which is substantially the same as the above-described communication plate 15 in a plan view, is bonded to the protection substrate 30, and is also bonded to the above-described communication plate 15. Specifically, the case member 40 has a recess portion 41 having a depth by which the flow path forming substrate 10 and the protection substrate 30 are accommodated on the protection substrate 30 side. The recess portion 41 has an opening area which is wider than a surface bonded to the flow path forming substrate 10 of the protection substrate 30. In addition, in a state where the flow path forming substrate 10 or the like is accommodated in the recess portion 41, the opening surface on the nozzle plate 20 side of the recess portion 41 is sealed by the communication plate 15. Accordingly, on an outer circumferential portion of the flow path forming substrate 10, a third manifold portion 42 is divided by the case member 40 and the flow path forming substrate 10. In addition, the manifold 100 of the embodiment is configured of the first manifold portion 17 and the second manifold portion 18 which are provided on the communication plate 15, and the third manifold portion 42 divided by the case member 40 and the flow path forming substrate 10. The manifolds 100 are provided to be continuous throughout the first direction X which is the arranging direction of the pressure generation chamber 12, and the supply paths 19 which communicate with each of the pressure generation chamber 12 and the manifold 100 are aligned in the first direction X.

In addition, on the surface on the Z2 side on which the first manifold portion 17 and the second manifold portion 18 of the communication plate 15 are open, a compliance substrate 45 is provided. The compliance substrate 45 seals an opening on the liquid ejecting surface 20*a* side of the first manifold portion 17 and the second manifold portion 18. In the embodiment, the compliance substrate 45 includes a sealing film 46 made of a flexible thin film, and a fixing substrate 47 made of a hard material, such as metal. A region which opposes the manifold 100 of the fixing substrate 47 becomes an opening portion 48 which is completely removed in the thickness direction, one surface of the manifold 100 becomes a compliance portion 49 which is a flexible portion which is sealed only with the flexible sealing film 46.

In addition, in the case member 40, an introduction path 44 for penetrating the manifold 100 and supplying the ink to each of the manifolds 100, is provided. In addition, in the case member 40, a connection port 43 which communicates with the through hole 32 of the protection substrate 30, and into which the flexible cable 120 inserts, is provided.

In the recording head 1, when ejecting the ink, the ink is taken in from the introduction path 44, and the inside of the flow path from the manifold 100 to the nozzle opening 21, is filled with the ink. After this, in accordance with a signal from the driving circuit 121, by applying the voltage to each of the active portions 310 which correspond to the discharge pressure generation chambers 12A, the vibrating plate 50 is deflected together with the active portion 310. Accordingly, the pressure on the inside of the discharge pressure generation chamber 12A increases, and the ink droplets are ejected from the predetermined nozzle opening 21.

Here, a forming method of the supply path 19 and the second manifold portion 18 in the communication plate 15 will be described with reference to FIGS. 10 to 14. In addition, FIGS. 10 to 14 are sectional views illustrating a manufacturing method of the communication plate.

Figure 10:
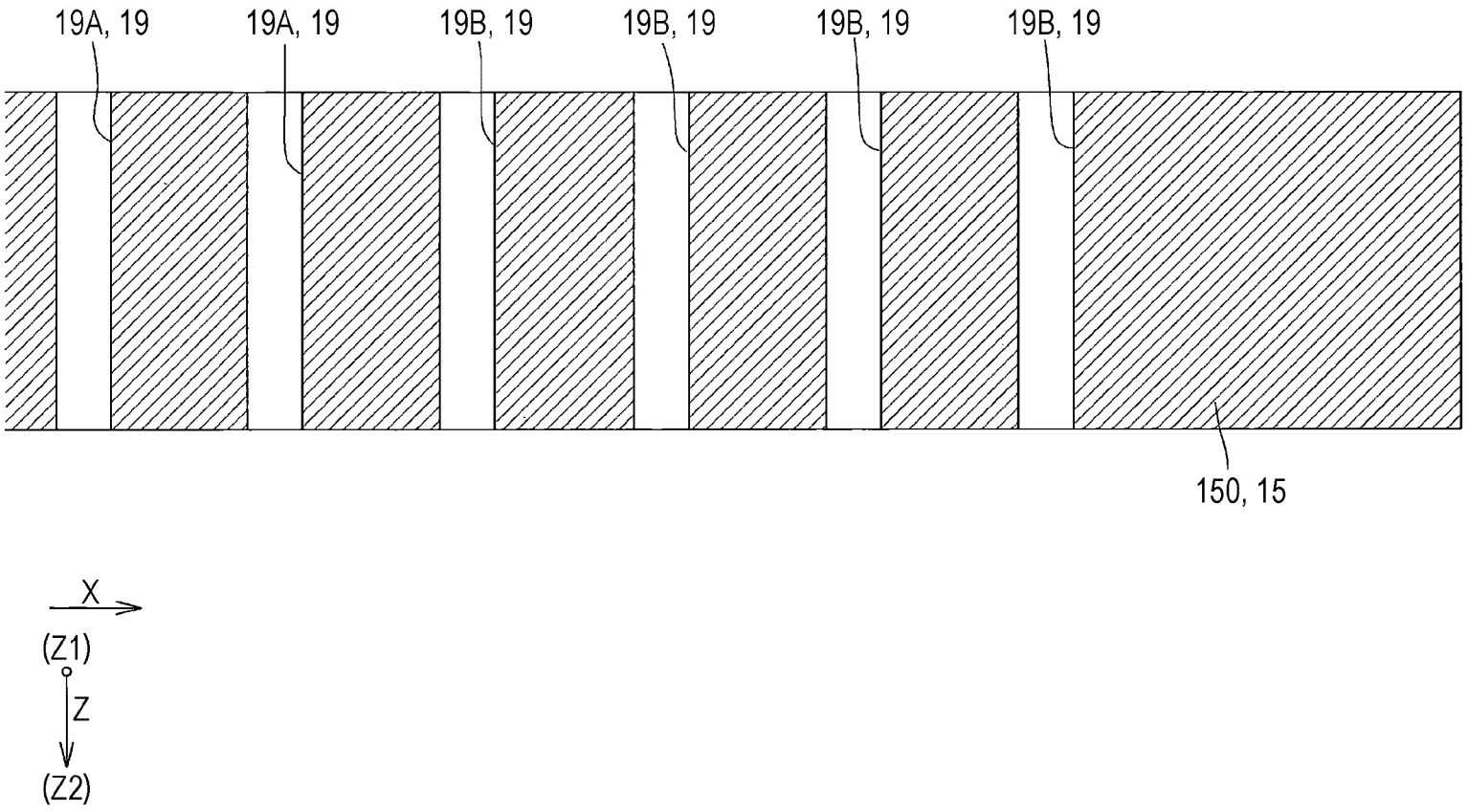
FIG. 10 is a sectional view illustrating the manufacturing method of the recording head according to Embodiment 1 of the invention.

First, as illustrated in FIG. 10, the supply path 19 which becomes the discharge supply path 19A and the dummy supply path 19B is formed on a base material 150 which is a silicon single crystal substrate that becomes the communication plate 15. The forming method of the supply path 19 is not particularly limited, and for example, it is possible to form the supply path 19 by using at least one method selected from laser processing, etching of the Bosch process, and sandblasting processing.

Figure 11:
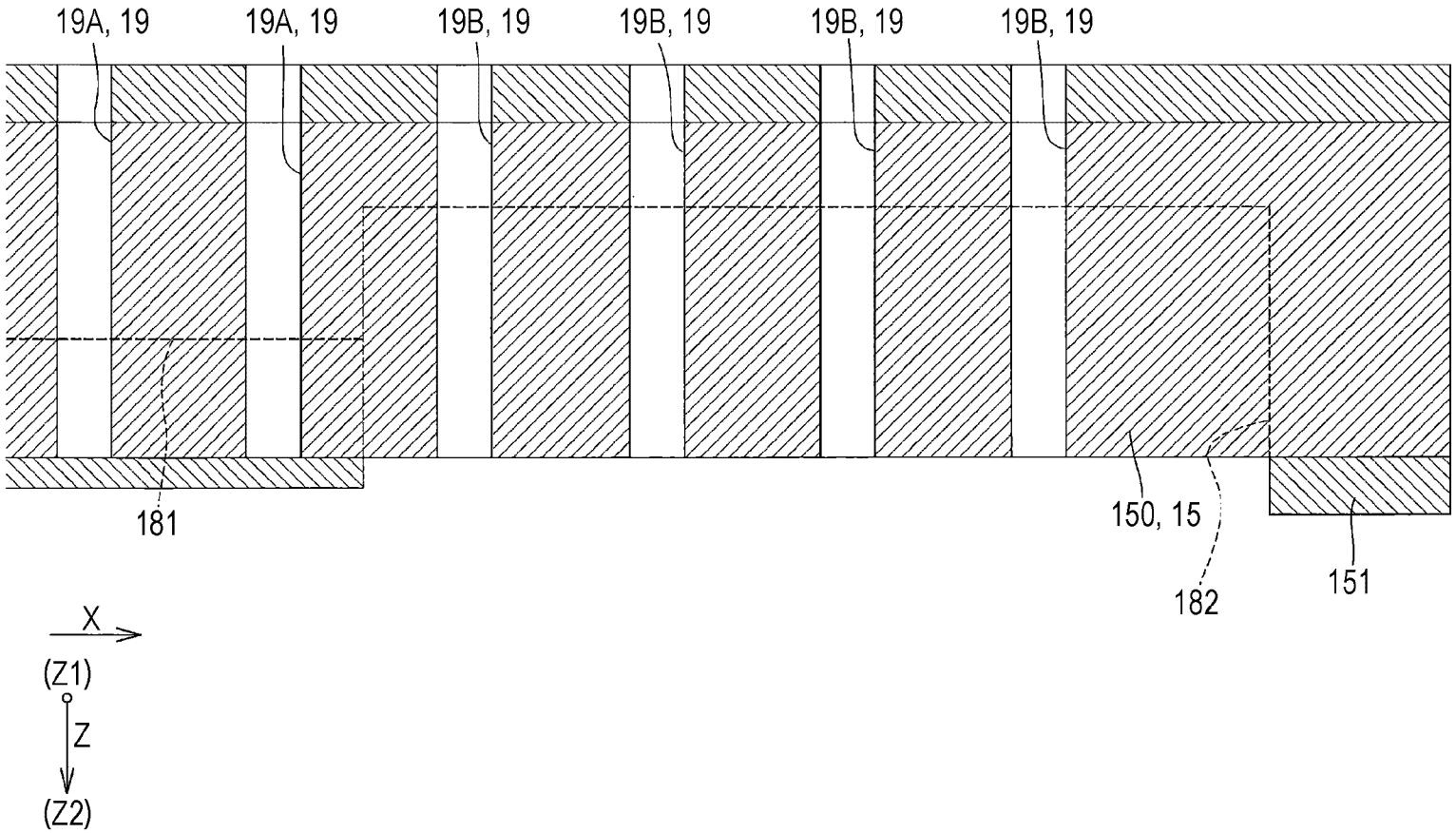
FIG. 11 is a sectional view illustrating the manufacturing method of the recording head according to Embodiment 1 of the invention.

Next, as illustrated in FIG. 11, a mask 151 which has an opening at a part which becomes the second recess portion 182, is formed on a front surface of the base material 150. At this time, the mask 151 in a region in which the first recess portion 181 is formed becomes thin by performing half etching. Accordingly, by reducing the thickness of the mask 151 in a later processing, the region in which the first recess portion 181 is formed is open.

Figure 12:
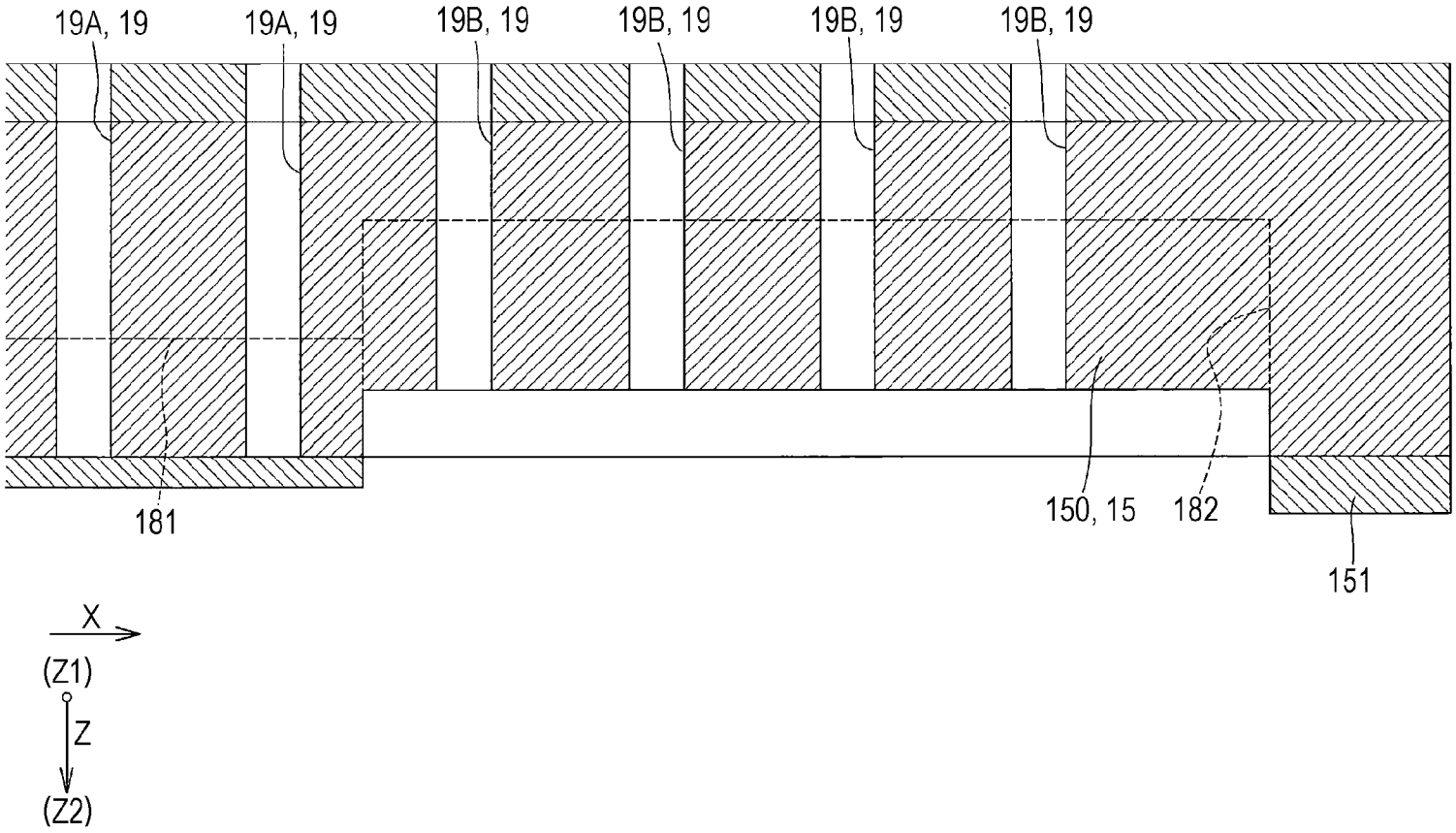
FIG. 12 is a sectional view illustrating the manufacturing method of the recording head according to Embodiment 1 of the invention.

Next, as illustrated in FIG. 12, by performing the anisotropic etching using the alkaline solution, such as KOH, with respect to the base material 150, a part of the depth of the second recess portion 182 is formed. In other words, here, without completely forming the depth of the second recess portion 182, only a part is formed.

Figure 13:
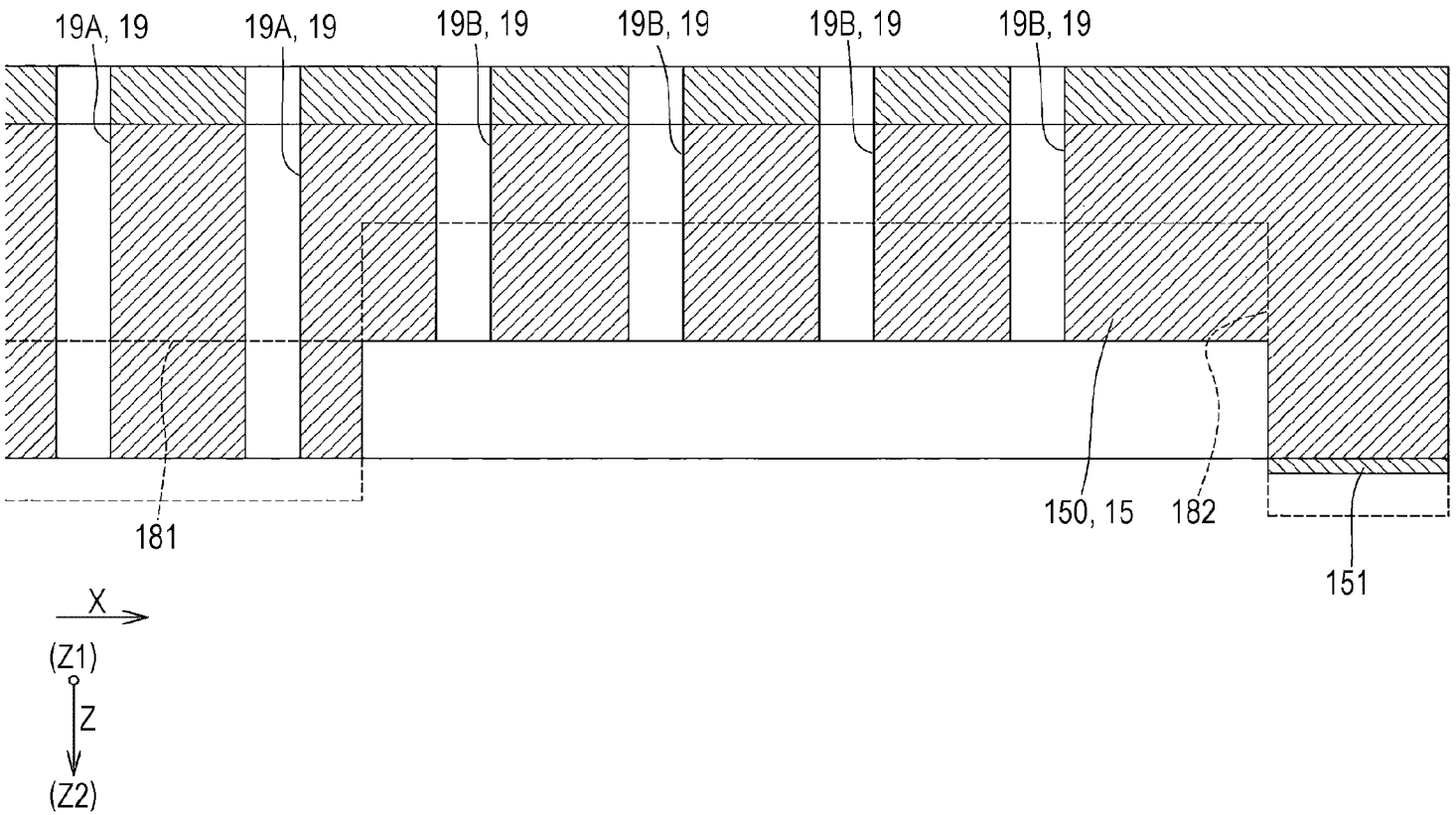
FIG. 13 is a sectional view illustrating the manufacturing method of the recording head according to Embodiment 1 of the invention.

Next, as illustrated in FIG. 13, the thickness of the mask 151 is thin. Accordingly, in addition to the region in which the second recess portion 182 is formed, the region in which the first recess portion 181 is formed is also open.

Figure 14:
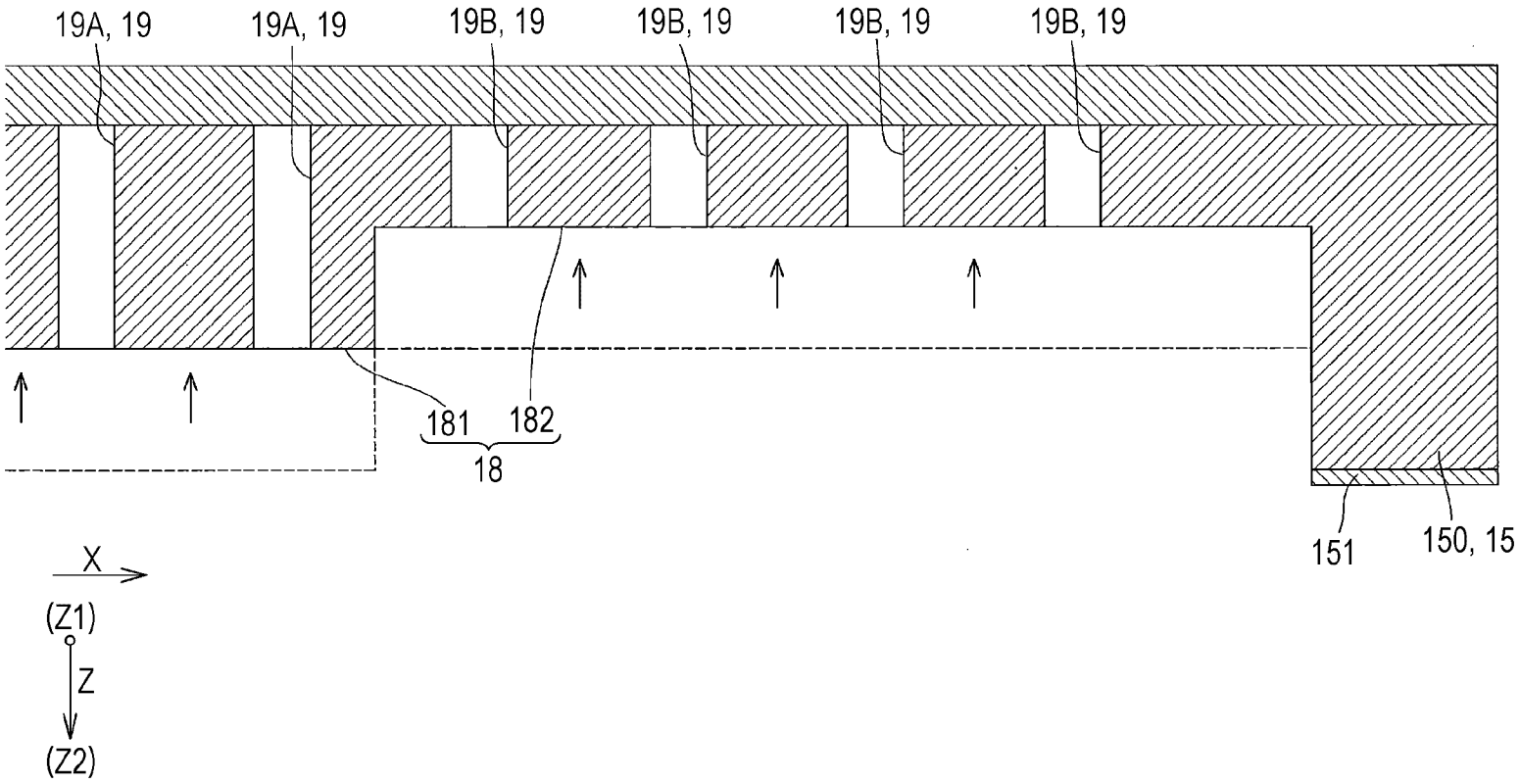
FIG. 14 is a sectional view illustrating the manufacturing method of the recording head according to Embodiment 1 of the invention.

Next, as illustrated in FIG. 14, by performing the anisotropic etching with respect to the base material 150, the second manifold portion 18 which has the first recess portion 181 and the second recess portion 182 is formed. In other words, in the processing, a remaining part of the second recess portion 182 is formed at the same time when the first recess portion 181 is formed.

By performing the above-described processing, in the communication plate 15, the supply path 19, and the second manifold portion 18 having the first recess portion 181 and the second recess portion 182, are formed. In addition, the nozzle communication path 16 may be formed at the same time in the process of forming the above-described supply path 19, or may be formed in other processes. In addition, the first manifold portion 17 may be formed by the anisotropic etching, or may be formed by dry etching or laser processing.

In this manner, since the base material 150 of the communication plate 15 is made of a silicon single crystal substrate in which the crystal plane orientation of the front surface is a {110} plane, the bottom surfaces of the first recess portion 181 and the second recess portion 182 is formed of the {110} plane. In addition, the inclined surface 183 between the first recess portion 181 and the second recess portion 182 is formed of the first inclined surface 183*a* which is an arbitrary surface (etching rate is high), and the second inclined surface 183*b* which is the third {111} plane (refer to FIG. 8). Therefore, processing of additionally forming the inclined surface 183 becomes unnecessary, and it is possible to reduce costs.

Embodiment 2

Figure 15:
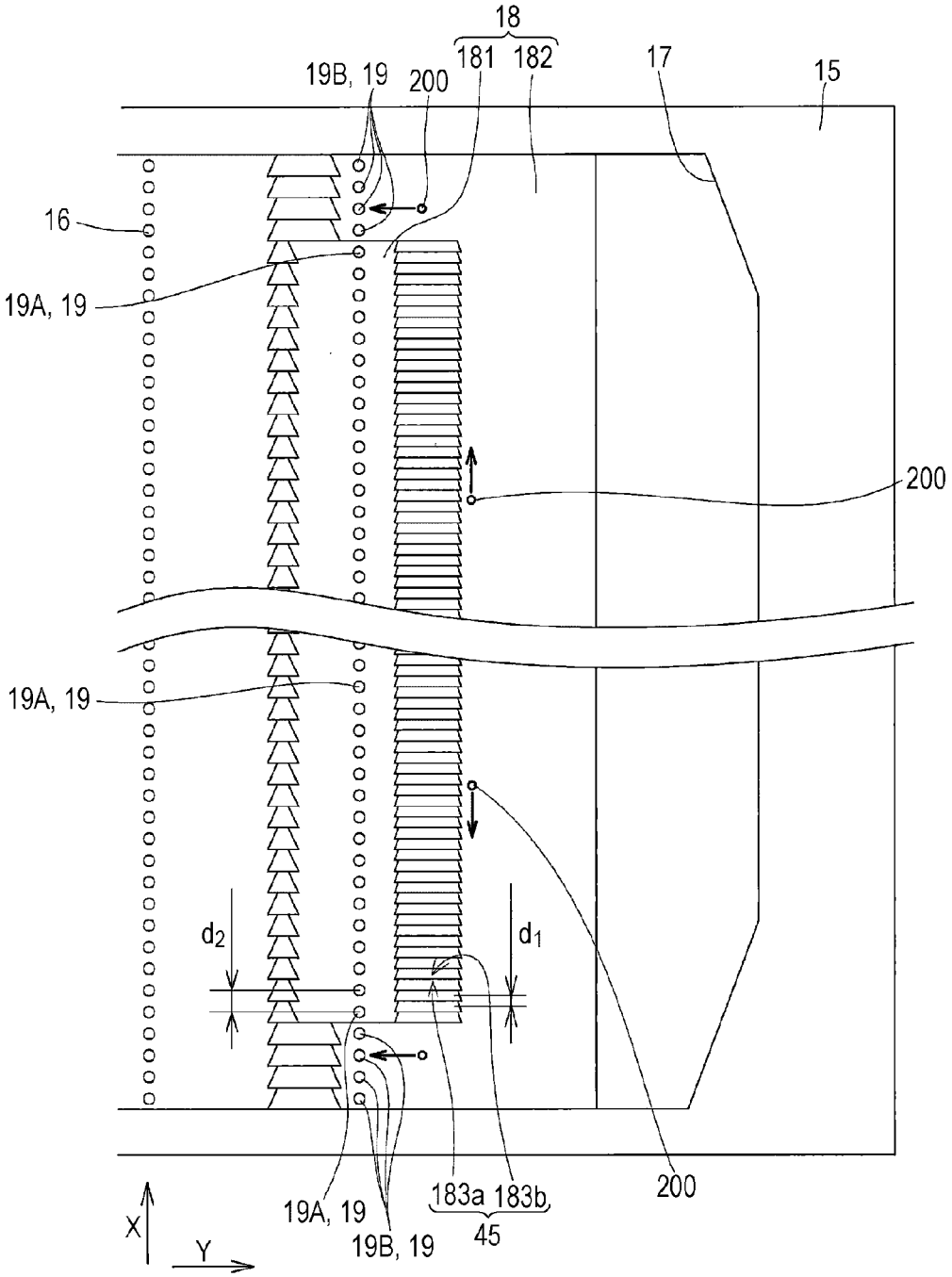
FIG. 15 is a plan view of a communication plate according to Embodiment 2 of the invention.

FIG. 15 is a plan view of the communication plate according to Embodiment 2 of the invention. In addition, the members similar to those of the above-described embodiment 1 are given the same reference numerals, and overlapping description will be omitted.

As illustrated in FIG. 15, in the communication plate 15 of the embodiment, as the second manifold portion 18, the first recess portion 181 and the second recess portion 182 are formed, and the inclined surface 183 is formed between the first recess portion 181 and the second recess portion 182.

In the inclined surface 183, the first inclined surface 183*a* which is an arbitrary surface and the second inclined surface 183*b* which is the third {111} plane are alternately arranged and formed in the first direction X.

The bubble discharge characteristics in the inclined surface 183 are determined by the ink speed in the first direction X, the ink characteristics, and the pitch $d_1$ of the second inclined surface 183*b*. Here, the pitch $d_1$ in the first direction X of the second inclined surface 183*b* is smaller than the pitch $d_2$ of the supply path 19 ($d_1<d_2$). Here, the pitch $d_1$ is a distance between the centers of the second inclined surfaces 183*b* adjacent to each other in the first direction X, and the pitch $d_2$ is a distance between the centers of the supply paths 19 adjacent to each other in the first direction X.

In this manner, by making the pitch $d_1$ of the second inclined surface 183*b* smaller than the pitch $d_2$ of the supply path 19, as described in FIG. 8, it is possible to prevent bubbles 200 which moves in the first direction X in the inclined surface 183 from being caught, and to make it easy to move the bubbles 200 in the first direction X along the inclined surface 183. Therefore, the bubbles 200 are likely to move on the dummy supply path 19B side, and it is possible to improve the bubble discharge characteristics.

Meanwhile, the pitch $d_2$ of the supply path 19 is formed according to the pitch of the nozzle opening 21, and in a case where the nozzle opening 21 is 300 dpi, the pitch $d_2$ of the supply path 19 becomes approximately 84.7 μm. Meanwhile, the pitch $d_1$ of the second inclined surface 183*b* may be a pitch smaller than 84.7 μm, and for example, a pitch of a case where the nozzle opening 21 is 600 dpi, that is, a pitch which is equal to or smaller than approximately 42.4 μm is preferable, and a pitch of a case of 1200 dpi, that is, a pitch which is approximately 21.3 μm is appropriate. In this manner, by making the pitch $d_1$ of the second inclined surface 183*b* equal to or less than approximately 42.4 μm, and preferably, equal to or less than 21.3 μm, since overhanging in the second direction Y of the inclined surface 183 becomes small, the bubbles 200 is not caught on the inclined surface 183, and it is possible to move the bubbles 200 in the first direction X.

Embodiment 3

Figure 16:
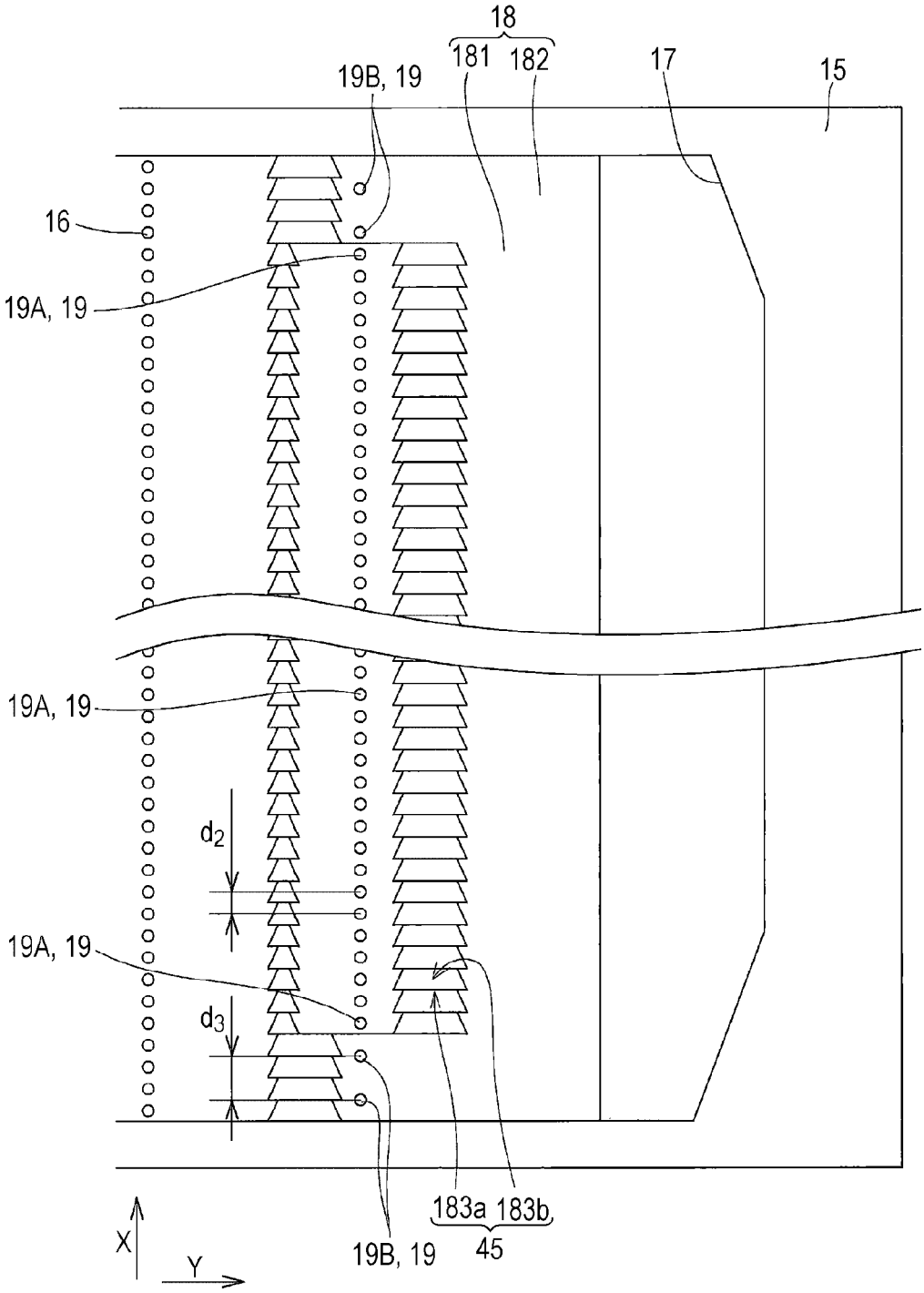
FIG. 16 is a plan view of a communication plate according to Embodiment 3 of the invention.

FIG. 16 is a plan view of the communication plate according to Embodiment 3 of the invention. In addition, the members similar to those of the above-described embodiments are given the same reference numerals, and overlapping description will be omitted.

As illustrated in FIG. 16, in the communication plate 15 of the embodiment, the plurality of supply paths 19 which are made of the discharge supply path 19A that is open on the bottom surface of the first recess portion 181, and the dummy supply path 19B that is open on the bottom surface of the second recess portion 182, are provided.

A pitch $d_3$ of the dummy supply path 19B is greater than the pitch $d_2$ of the discharge supply path 19A ($d_3>d_2$). Therefore, the cross-sectional area from the dummy supply path 19B to the nozzle opening 21 can be increased. In other words, by increasing the pitch $d_3$ of the dummy supply paths 19B adjacent to each other, it is possible to ensure a space between the dummy supply paths 19B adjacent to each other. Therefore, it is possible to increase the opening diameter of the dummy supply path 19B. In addition, when the pitch of the dummy pressure generation chamber 12B which communicates with the dummy supply path 19B is also increases according to the dummy supply path 19B, it is possible to increase the cross-sectional area of the pressure generation chamber 12B regardless of the opening diameter of the dummy supply path 19B. Similarly, it is also possible to increase the cross-sectional area of the nozzle communication path 16, and to increase the nozzle opening 21. In other words, by increasing the pitch $d_3$ of the dummy supply path 19B, it is also possible to increase the pitch of the flow path of the pressure generation chamber 12B, the nozzle communication path 16, and the nozzle opening 21, which communicate with the dummy supply path 19B. In other words, by increasing the pitch $d_3$ of the dummy supply path 19B, it is also possible to increase the pitch of the flow path of the dummy pressure generation chamber 12B, the nozzle communication path 16, and the nozzle opening 21 which communicate therewith. In other words, by increasing the pitch $d_3$ of the dummy supply path 19B, it is possible to increase at least one cross-sectional area which is selected from the dummy supply path 19B, the pressure generation chamber 12B, the nozzle communication path 16, and the nozzle opening 21. Accordingly, it is possible to further reduce the flow path resistance from the discharge dummy supply path 19B to the nozzle opening 21 compared to the flow path resistance from the dummy supply path 19B to the nozzle opening 21 compared to the flow path resistance from the discharge supply path 19A to the nozzle opening 21, and to further improve the bubble discharge characteristics.

It is needless to say that the supply path 19 of the embodiment can further improve the bubble discharge characteristics by being combined with the inclined surface 183 of the above-described Embodiment 2.

Other Embodiments

Above, each embodiment of the invention is described, but basic configurations of the invention are not limited to the description above.

For example, in the above-described Embodiments, the dummy supply paths 19B are provided in both end portions in the first direction X which is the arranging direction of the supply path 19, but not being particularly limited thereto, the disposition of the dummy supply path 19B is not limited to both end portions in the first direction X, and additionally, the second recess portion 182 may be formed according to the positions of the dummy supply path 19B. In addition, the number of dummy supply paths 19B is not limited to that in the above-described Embodiments 1 to 3, and the number of dummy supply path 19B may be one, or may be two or more.

In addition, in each of the above-described embodiments, the first inclined surface 183*a* and the second inclined surface 183*b* which have different angles with respect to the first direction X are alternately disposed in the inclined surface 183, but not being particularly limited thereto, the inclined surface 183 may be formed in one second inclined surface 183*b*. In other words, the second manifold portion 18 may be formed along the angle of the second inclined surface 183*b*. In other words, the first direction X of the communication plate 15 may be used to be the direction along the third {111} plane that configures the second inclined surface 183*b*.

Furthermore, in each of the above-described embodiments, as the communication plate 15, the silicon substrate in which the crystal plane orientation of the front surface is a {110} plane is used, and the second manifold portion 18 is formed by performing the anisotropic etching, but not being particularly limited thereto, for example, as the communication plate 15, a silicon substrate in which the crystal plane orientation is a {110} plane may be used, or an SOI substrate and a material, such as glass may be used. In addition, the forming method of the second manifold portion 18 is also not limited to the anisotropic etching, and for example, dry etching or mechanical processing may be employed.

In addition, in each of the above-described embodiments, a configuration in which the thin film-type piezoelectric actuator 300 is used as a pressure generation unit which generates a pressure change in the pressure generation chamber 12, is described, but not being particularly limited thereto, for example, it is possible to use a thick film-like piezoelectric actuator which is formed by a method of sticking a green sheet, or a longitudinal vibration-type piezoelectric actuator which layers a piezoelectric material and an electrode forming material alternately, and stretches and contracts the materials in the shaft direction. In addition, as the pressure generation unit, it is possible to use a unit which disposes a heat generation element on the inside of a pressure generation chamber, and discharges liquid droplets from the nozzle opening by the bubbles generated due to heat generation of the heat generation element, or a unit which generates static electricity between a vibration plate and an electrode, modifies the vibration plate by an electrostatic force, and discharges the liquid droplets from the nozzle opening, which is a so-called electrostatic actuator.

Figure 17:
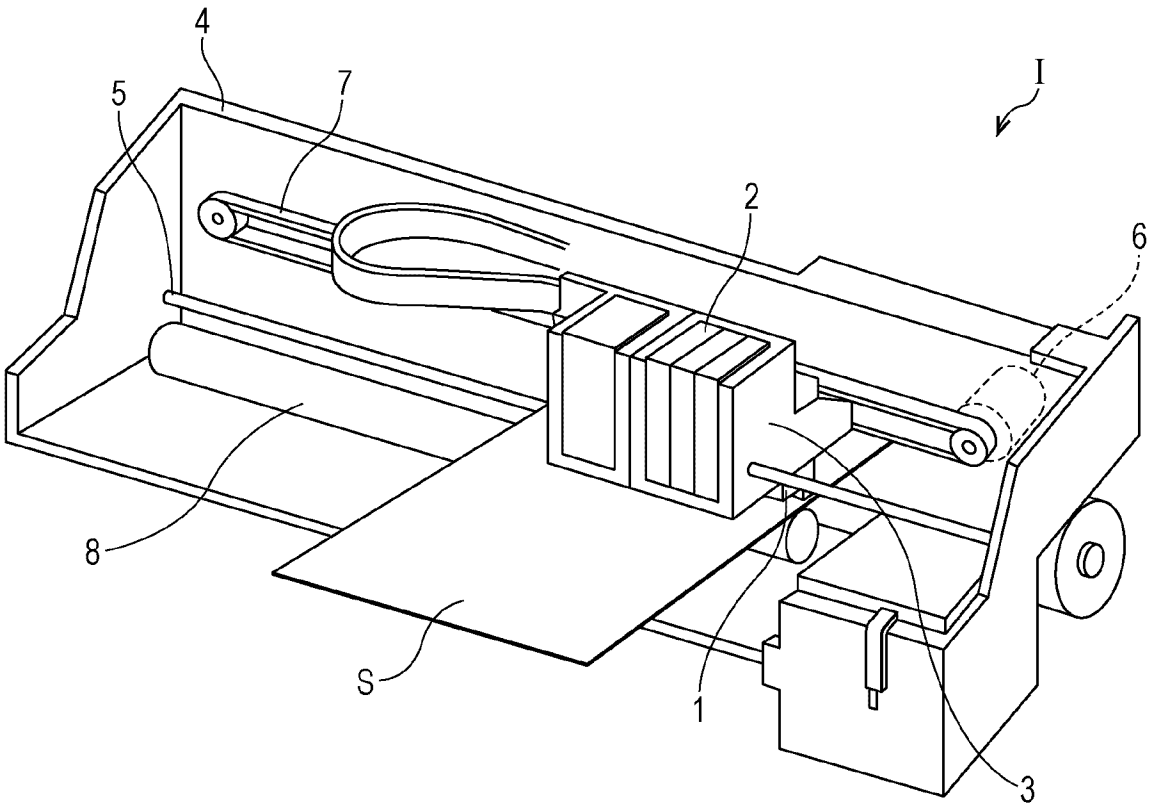
FIG. 17 is a schematic view of a recording device according to one embodiment of the invention.

The recording head 1 is mounted on an ink jet type recording device I. FIG. 17 is a schematic view illustrating an example of the ink jet type recording device of the embodiment.

In the ink jet type recording device I illustrated in FIG. 17, in the recording head 1, a cartridge 2 which configures a liquid supply unit is provided to be attachable and detachable, and a carriage 3 on which the recording head 1 is mounted is provided to freely move in the shaft direction to a carriage shaft 5 attached to a device main body 4.

In addition, as a driving force of a driving motor 6 is transmitted to the carriage 3 via a plurality of gears which are not illustrated and a timing belt 7, the carriage 3 on which the recording head 1 is mounted moves along the carriage shaft 5. Meanwhile, a transporting roller 8 which serves as a transporting unit is provided in the device main body 4, and a recording sheet S which is a recording medium, such as a paper sheet, is transported by the transporting roller 8. In addition, the transporting unit which transports the recording sheet S may be a belt or a drum, not being limited to the transporting roller.

In addition, in the above-described example, the ink jet type recording device I has a configuration in which the cartridge 2 which is an ink supply unit is mounted on the carriage 3, but not being particularly limited thereto, for example, the liquid supply unit, such as an ink tank, may be fixed to the device main body 4, and the liquid supply unit and the recording head 1 may be connected to each other via a supply pipe, such as a tube. In addition, the liquid supply unit may not be mounted on the ink jet type recording device.

Furthermore, in the above-described ink jet type recording device I, an example in which the recording head 1 is mounted on the carriage 3 and moves in the main scanning direction, is illustrated, but not being particularly limited thereto, for example, the invention can also be employed in a so-called line type recording device which performs printing only by fixing the recording head 1 and by moving the recording sheet S, such as a paper sheet, in the sub-scanning direction.

In addition, a target of the invention is a widely general liquid ejecting head, and for example, the invention can also be employed in the recording head, such as various types of ink jet type recording head which is used in an image recording device, such as a printer; a color material ejecting head which is used in manufacturing a color filter, such as a liquid crystal display; an electrode material ejecting head which is used in forming an electrode, such as an organic EL display or an FED (field emission display); and a bio-organic ejecting head which is used in manufacturing a bio chip. In addition, as an example of the liquid ejecting apparatus, the ink jet type recording device I is described, but the invention can also be used in the liquid ejecting apparatus in which other liquid ejecting heads described above are used.

The entire disclosure of Japanese Patent Application No. 2016-016285 filed Jan. 29, 2016 is expressly incorporated by reference herein in its entirety.

What is claimed is:

1. A liquid ejecting head comprising:

a flow path forming substrate in which a plurality of pressure generation chambers are formed, the plurality of pressure generation chambers including a pressure generation chamber which communicates with a nozzle opening that discharges liquid; and a communication plate which has a supply path that communicates with a manifold which is common to and communicates with the plurality of pressure generation chambers, and with the pressure generation chamber, wherein a recess portion which configures at least a part of the manifold is provided to be open on a side opposite to the flow path forming substrate, on the communication plate, wherein the recess portion is provided with a first recess portion, and a second recess portion which is deeper than the first recess portion, wherein the supply path includes a discharge supply path which communicates with a discharge pressure generation chamber that discharges liquid from the nozzle opening, and a dummy supply path which communicates with a dummy pressure generation chamber that does not discharge liquid from a nozzle opening that communicates with the dummy pressure generation chamber, wherein the discharge supply path is provided to be open on a bottom surface of the first recess portion, and wherein the dummy supply paths are provided to be open on a bottom surface of the second recess portion.

2. The liquid ejecting head according to claim 1, wherein the supply paths are arranged in a first direction, and wherein at least one or more dummy supply paths are provided on an end portion side in the first direction.

3. The liquid ejecting head according to claim 2, wherein the dummy supply paths are provided in each of both end portions in the first direction.

4. The liquid ejecting head according to claim 1, wherein the communication plate is a silicon substrate which becomes a plane in which a crystal plane orientation of a front surface is a {110} plane, wherein the bottom surfaces of the first recess portion and the second recess portion are formed of a plane in which a crystal plane orientation is a {110} plane, wherein, between the first recess portion and the second recess portion, an inclined surface which is inclined toward the bottom surface of the second recess portion from the bottom surface of the first recess portion, is provided, and wherein the inclined surfaces are formed of an arbitrary surface which is inclined with respect to the {110} plane, the {110} plane and a third {111} plane which is inclined with respect to a first {111} plane perpendicular to the {110} plane.

5. The liquid ejecting head according to claim 4, wherein, on the inclined surfaces, a plurality of second inclined surface formed on the third {111} planes are arranged throughout a first direction in which is the supply paths are arranged, and wherein a pitch of the second inclined surfaces adjacent to each other in the first direction is greater than a pitch of the supply paths adjacent to each other in the first direction.

6. The liquid ejecting head according to claim 5, wherein the pitch of the second inclined surface is equal to or less than 42.4 μm.

7. The liquid ejecting head according to claim 1, wherein a pitch of the dummy supply paths adjacent to each other is greater than a pitch of the discharge supply paths adjacent to each other.

8. A liquid ejecting apparatus comprising:

the liquid ejecting head according to claim 1.

9. A liquid ejecting apparatus comprising:

the liquid ejecting head according to claim 2.

10. A liquid ejecting apparatus comprising:

the liquid ejecting head according to claim 3.

11. A liquid ejecting apparatus comprising:

the liquid ejecting head according to claim 4.

12. A liquid ejecting apparatus comprising:

the liquid ejecting head according to claim 5.

13. A liquid ejecting apparatus comprising:

the liquid ejecting head according to claim 6.

14. A liquid ejecting apparatus comprising:

the liquid ejecting head according to claim 7.

15. The liquid ejecting apparatus according to claim 8, wherein suctioning means performs a suction operation only from the nozzle opening that communicates with the dummy pressure generation chamber.

* * * * *